United States Patent [19]

Wise

[11] 4,338,843

[45] Jul. 13, 1982

[54] ASYNCHRONOUS INTERFACE FOR ELECTRONIC MUSICAL INSTRUMENT WITH MULTIPLEXED NOTE SELECTION

[75] Inventor: Stephen A. Wise, Macungie, Pa.

[73] Assignee: Allen Organ Co., Macungie, Pa.

[21] Appl. No.: 111,458

[22] Filed: Jan. 11, 1980

[51] Int. Cl.[3] ..... G10H 1/00

[52] U.S. Cl. ..... 84/1.01; 84/1.03

[58] Field of Search ..... 84/1.01, 1.03, 1.24; 364/200MS File, 900 MS File; 340/365 S

[56] References Cited

U.S. PATENT DOCUMENTS

| | | | |
|---|---|---|---|
| 3,696,201 | 10/1972 | Arsem et al. | 84/1.01 |
| 3,719,767 | 3/1973 | Matumoto et al. | 84/1.01 |
| 3,772,657 | 9/1973 | Marsalka et al. | 364/200 |
| 3,809,786 | 5/1974 | Deutsch | 84/1.01 |
| 3,821,712 | 6/1974 | Wetzel | 84/1.01 X |
| 3,821,714 | 6/1974 | Tomisawa et al. | 84/1.01 X |
| 3,867,579 | 2/1975 | Colton et al. | 364/200 |
| 3,889,568 | 6/1975 | Amaya | 84/1.01 |
| 3,894,463 | 7/1975 | Rocheleau | 84/1.01 |
| 3,915,047 | 10/1975 | Davis et al. | 84/1.03 |
| 3,951,028 | 4/1976 | Robinson | 84/1.01 |
| 3,955,459 | 5/1976 | Mochida et al. | 84/1.01 |
| 3,986,423 | 10/1976 | Rossum | 84/1.01 |
| 3,999,458 | 12/1976 | Suzuki | 84/1.01 |
| 4,022,097 | 5/1977 | Strangio | 84/1.03 |
| 4,023,454 | 5/1977 | Obayashi et al. | 84/1.01 |
| 4,054,078 | 10/1977 | Kondo | 84/1.24 |
| 4,058,043 | 11/1977 | Shibahara | 84/1.03 |
| 4,072,078 | 2/1978 | Shallenberger et al. | 84/1.03 |
| 4,073,209 | 2/1978 | Whittington et al. | 84/1.24 |
| 4,078,465 | 3/1978 | Wheelwright | 84/1.01 |
| 4,099,437 | 7/1978 | Stavron et al. | 84/1.01 |
| 4,129,055 | 12/1978 | Whittington et al. | 84/1.01 |
| 4,137,562 | 1/1979 | Boeck et al. | 364/200 |
| 4,141,268 | 2/1979 | Kugisawa | 84/1.03 |
| 4,147,083 | 4/1979 | Woron et al. | 84/1.01 |
| 4,148,241 | 4/1979 | Morez et al. | 84/1.03 |
| 4,160,399 | 7/1979 | Deutsch | 84/1.03 |
| 4,179,748 | 12/1979 | Brown et al. | 340/365 S |

*Primary Examiner*—J. V. Truhe
*Assistant Examiner*—Forester W. Isen
*Attorney, Agent, or Firm*—Seidel, Gonda, Goldhammer & Panitch

[57] ABSTRACT

An asynchronous interface between a data input system (computer) and the keyboard multiplexer of an electronic musical instrument (digital organ) includes a pair of RAMs. The interface synthesizes the multiplexed keyboard data stream of the digital organ by swapping read and write operations between the two RAMs. Predetermined key data (WRITE DATA) provided by the computer is written into one RAM during a WRITE interval while key data (READ DATA) previously written into the other RAM is sequentially read out of the latter RAM. The WRITE DATA designates those keys on the organ keyboard which are to be simulated as being active. The read and write operations are alternately applied to each RAM. If the READ DATA matches the key code assigned to a key on the keyboard, the appropriate note is sounded by the organ. The two RAMs can actually be two segregated portions of a single memory.

17 Claims, 17 Drawing Figures

I4PLSE
20
38
34
34-1
34-2
34-6
NT1
NT2
NT6
R1
R2
R6
24
32
32-64
ODDIV4
ODDC24
36-64
36-128
36-384
DECODER
32-6
32-5
32-4
32-3
32-2
32-1
36-1
36-65
36-321
SWITCHING ARRAY
22
ODDC14
ODDC13
ODDC12
ODDC11
ODDC22
ODDC21
ODDIV1

ASYNCHRONOUS INTERFACE FOR ELECTRONIC MUSICAL INSTRUMENT WITH MULTIPLEXED NOTE SELECTION

BACKGROUND OF THE INVENTION

The invention is directed to an asynchronous interface for use with keyed electronic musical instruments. In particular, the invention is directed to an asynchronous interface for electronically simulating or synthesizing the key contact closures of an electronic musical instrument having a keyboard multiplexer which digitally multiplexes key contact closures into a serial time signal, each key being represented by a unique time slot within the multiplexed signal. The invention is applicable to any musical instrument utilizing multiplexed notes and/or voice selection. It can be used in a sequencer, automatic player, automatic chord generator, automatic accompaniment player, multiple organ system (for keying the organs from a single group of contacts), voice selection circuits, and the like.

The keyboards and stop tabs of modern musical instruments are the product of centuries of adaptation to the human controlling mechanism (fingers, hands, feet). As such, the instruments perform excellently under the player's guidance.

It is often desirable, however, that some mechanical, electrical, or electronic system replace or augment the player's performance. Such systems are exemplified by the player piano, sequencers and the many automatic chord generators known in the electronic musical instrument field.

Early mechanized musical instrument controllers relied on rather complex mechanical or pneumatic hardware to physically depress the instrument keys to simulate a player's performance. The best known example of such a system is the player piano. Such systems are characterized by relatively cumbersome, expensive, and failure prone mechanical hardware. Later electrified controllers provided solenoids which also physically depressed the instrument keys (or operated the key relays). Although an improvement, such controllers were also burdened by rather cumbersome, expensive, and unreliable components.

The advent of electronic musical instruments having multiplexed systems for selection of notes and voices, as in the Allen digital computer organ, enables the use of improved electronic controllers for the musical instrument. By multiplexing key closure information to a single multiplexed data stream, it is unnecessary tor the controller to separately access each key. Instead, the controller can tap into the multiplexed keyboard data stream. Many performer augmentation devices such as automatic chord and bass generating systems have since been described and introduced for use with such multiplexed systems. Typically, these devices analyze key depressions made by the performer and generate complementary chords and bass notes by introducing additional keying information into the multiplexed data stream of the instrument.

U.S. Pat. Nos. 4,129,055 and 3,889,568 disclose various performer augmentation devices for use with an electronic musical instrument. U.S. Pat. No. 4,129,055 discloses a chord accompaniment circuit wherein, in a playback mode, data is transferred from a chord memory 44 to a chord generator 38. The chord data (based on key depressions) is written into a memory 52 in the program mode and is read out of the memory 52 in the playback mode. In U.S. Pat. No. 3,889,568, the chord data is stored in a RAM 3, and data is read out of the RAM by a pair of address circuits 5, 6 under control of a clock 7.

The use of various memory devices is also known in the electronic musical instrument field. For example, U.S. Pat. No. 3,894,463 discloses a tone generator wherein sampled (waveform) data from an A/D converter 15 is written into a RAM 16 at a relatively slow rate set by a clock 3. Data is read from the RAM at a higher rate set by a clock 23. Each read operation entails reading out all data in the RAM i.e., all waveform sample points, and takes place between successive write operations. Each write operation entails writing a single sample point of waveform data into the memory. U.S. Pat. No. 4,078,465 discloses a programmable memory wherein bi-directional transfer of data takes place between an input system 40 (keyboard), RAM 22 and EPROM 10; and between EPROM 10 and the musical instrument. Control of the data transfer is exercised by a data transfer control 64.

As the selection of notes and voices by means of keyboard multiplexing becomes more common due to advances in electronics technology, attention is focused on the design of systems having multiple musical instruments, remote keying systems, computer control systems, and digital sequencers. Such systems can be realized by an an interfacing device which can accept a standard input and produce as its output a multiplexed keying signal that is compatible with the signals and data normally generated by the musical instrument or instruments.

BRIEF SUMMARY OF THE INVENTION

The asynchronous interface of the present invention includes two buffer memories such as random access memories (RAMs). Key data (WRITE DATA) is written into one of the RAMs from a computer or other external data input device. During this time, key data (READ DATA) previously written into the other RAM is read from the RAM for use in generating multiplexed keying pulses which are compatible with the multiplexed keying pulses generated by the keyboard multiplexer of the musical instrument. After the write operation is completed, a DATA VALID signal generated by the computer undergoes transition and, at a convenient point in the keyboard multiplexing process, the two RAMs are swapped, i.e., the RAM that was previously written into is now read from, keyboard multiplexing pulses are derived from the key data (READ DATA) read from that RAM, and the RAM previously read from is written into by the computer. The interchange of the read/write roles between RAM's may continue indefinitely.

The interface includes a counter which is reset at the outset of each keyboard scan cycle of the keyboard multiplexer. The counter is advanced one count each time a new key is scanned by the keyboard multiplexer. The counter generates a unique key number or code for each scanned key of the instrument. As each key is scanned, the associated key number or code generated by the counter is compared with each of the key numbers (READ DATA) retrieved from the RAM being read from. If there is a match between the key number generated by the counter and any of the numbers (READ DATA) read from the RAM, a keyboard pulse is synthesized at the proper time and in synchronism with the keyboard multiplexer data stream of the musical instrument. The instrument plays the note corresponding to the synthesized keyboard pulse. No keyboard pulse is synthesized unless a key number generated by the counter matches a key number (READ DATA) read from the RAM.

It is not necessary for the data input device (computer) and the keyboard multiplexer of the musical instrument to share a common clock. Thus, the data input device and the musical instrument in effect operate asynchronously. The only so-called constraint is that the computer allow the roles of the interface RAMs to be swapped when each DATA VALID signal transition occurs before the computer attempts to write further data. In practice, this is no constraint at all because the keyboard multiplexer operates at a speed much greater than the rate of flow of data from the computer.

Plural musical instruments, each having a keyboard multiplexer, may be controlled by a single computer by providing an asynchronous interface for each instrument. To operate all instruments in unison, the computer may be provided with a single set of data output lines and the interfaces may be connected in parallel to the same set of data output lines from the computer. On the other hand, if independent control of each instrument is desired, the computer may be provided with different sets of data output lines and the interfaces may be separately connected to different sets of data output lines; or, as in the preferred embodiment described hereinafter, the computer may be provided with a single set of data output lines, each interface may be provided with a decode circuit, and the interfaces may be connected in parallel to the same set of data output lines from the computer.

For the purpose of illustrating the invention, there is shown in the drawing a form which is presently preferred; it being understood, however, that this invention is not limited to the precise arrangements and instrumentalities shown.

DETAILED DESCRIPTION OF THE INVENTION

Figure 1:
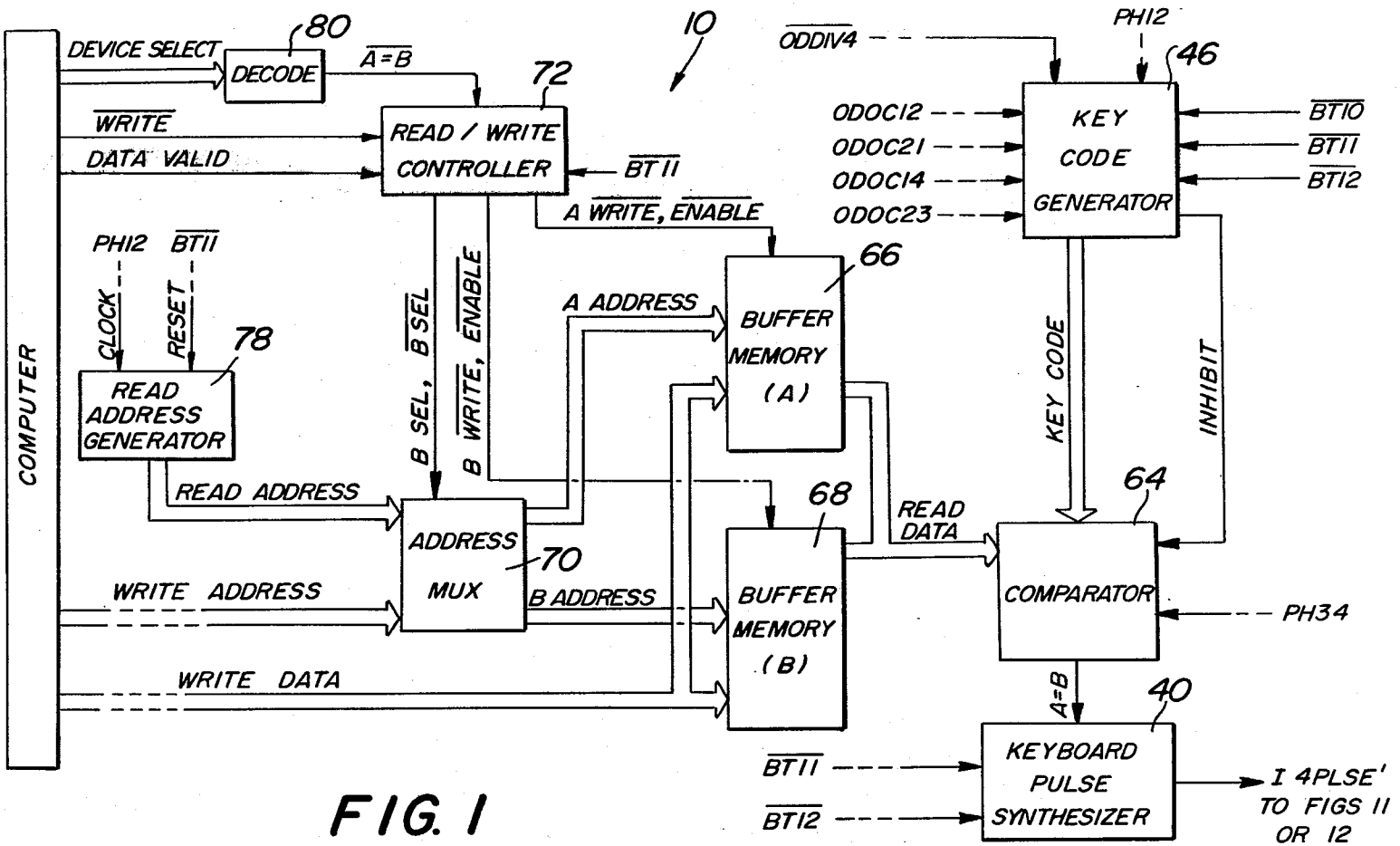
FIG. 1 is a block diagram of the asynchronous interface of the invention.
Figure 2:
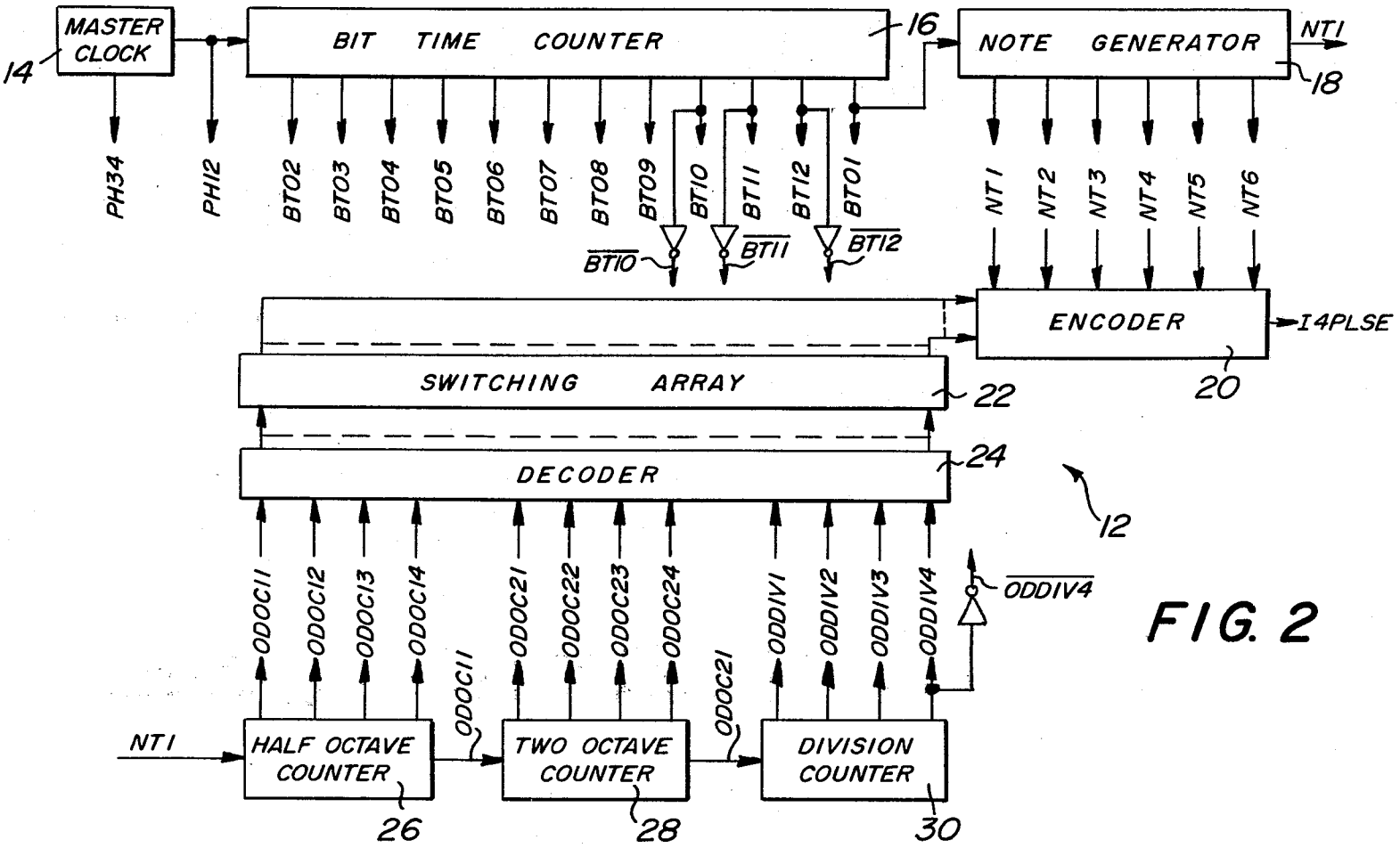
FIG. 2 is a block diagram of a conventional keyboard multiplexer of an electronic musical instrument.
Figure 3:
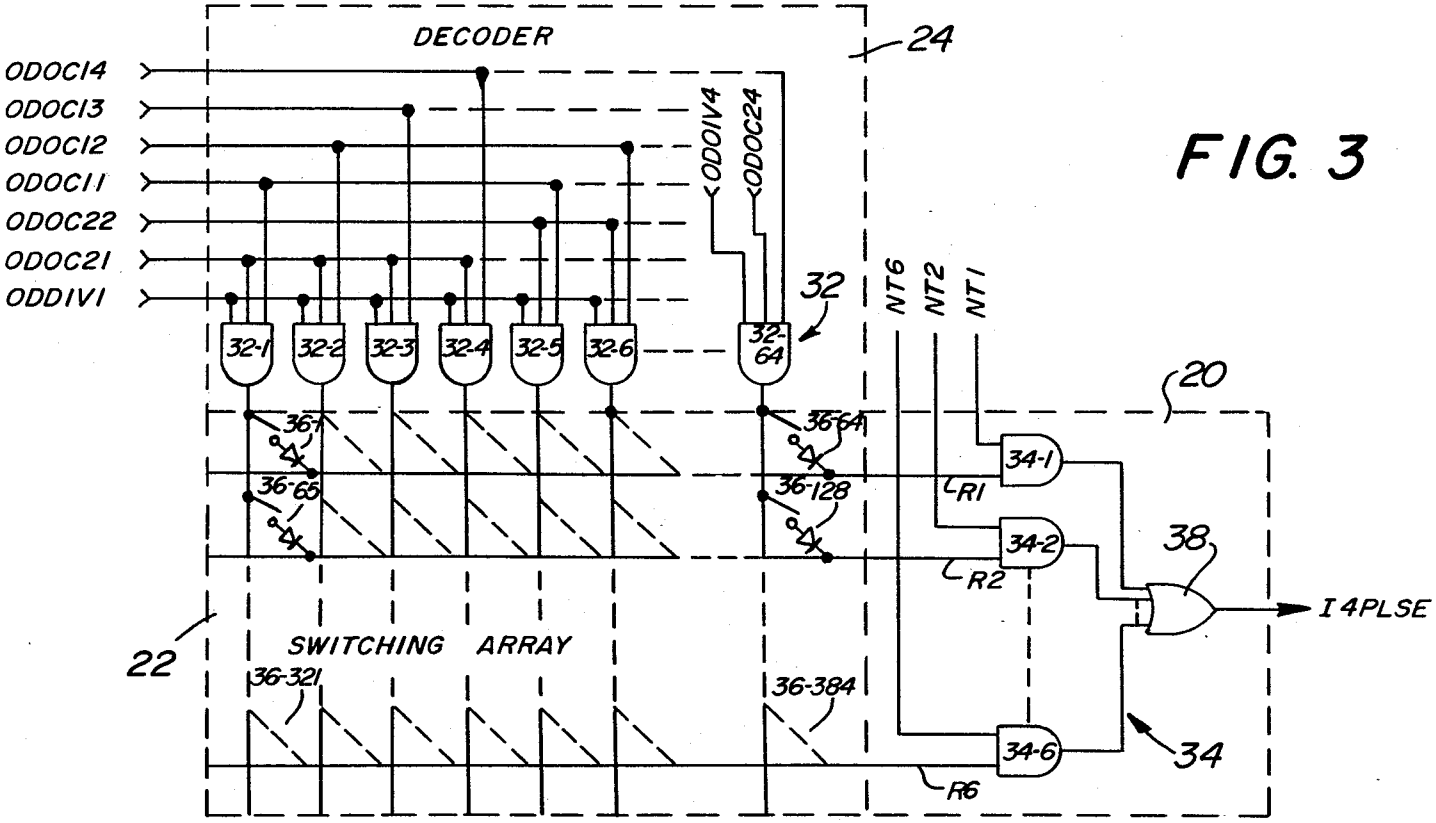
FIG. 3 is a schematic of the decoder, switching array, and encoder in FIG. 2.

Referring to the drawings, wherein like numerals indicate like elements, there is shown in FIG. 1 the asynchronous interface of the present invention, designated generally as 10. The interface 10 controls the keyboard multiplexer or multiplexing system of a conventional electronic musical instrument, such as the Allen digital computer organ. The keyboard multiplexer of the conventional musical instrument is shown in FIGS. 2 and 3, designated generally as 12, and is described hereinafter for ease of understanding of the operation of the asynchronous interface 10; although it is understood that the characteristic function and structure of the multiplexer 12 is well known in the art and is, for example, described particularly in U.S. Pat. No. 3,610,799, incorporated herein by reference. As used herein, the term "keyboard multiplexer" will be understood to mean any device which scans an array of switches and produces as its output a serial bit stream where any one switch is represented by a unique time slot within the stream.

Keyboard Multiplexer

Referring to FIG. 2, the keyboard multiplexer 12 of the conventional electronic musical instrument includes a master clock 14 which generates a clock signal PH12, typically 1 MHz. The PH12 signal clocks a cascaded string of ring counters, i.e. bit time counter 16 and note counter 18, the design and operation of which is well known to those skilled in the art. The bit time counter 16 is a modulo twelve counter which generates the bit time pulses BT01–BT12 (hereinafter sometimes referred to as BT pulses or signals). The note counter 18 is a modulo six counter. Note counter 18 is clocked on the rising edge of the BT01 pulse and generates the note time pulses NT1–NT6 (hereinafter sometimes referred to as NT pulses or signals) which are transmitted to an encoder 20 to encode the depression of keyboard switches (key contact closures).

The 14PLSE output of encoder 20 is the multiplexed keyboard data stream generated by the keyboard multiplexer 12. The data stream is divided into consecutive time slots, each slot corresponding to one of the keys of the instrument keyboard.

The encoder 20 encodes the outputs of a switching array 22. The switching array 22 is controlled by a decoder 24 and cascaded half octave counter 26, two octave counter 28, and division counter 30.

The half octave counter 26 is a modulo four counter. Counter 26 is clocked on the rising edge of the NT1 pulse and scans half octave sections of the instrument keyboard as indicated by pulse outputs ODOC1-1-ODOC14. The two octave counter 28, also a modulo four counter, is clocked on the rising edge of the ODOC11 pulse and scans two octave sections of the keyboard as indicated by pulse outputs ODOC2-1-ODOC24. The division counter 30, also a modulo four counter, is clocked on the rising edge of the ODOC21 pulse and scans individual divisions of the instrument keyboard as indicated by the pulse outputs ODD1V1-ODD1V4.

Figure 4A:
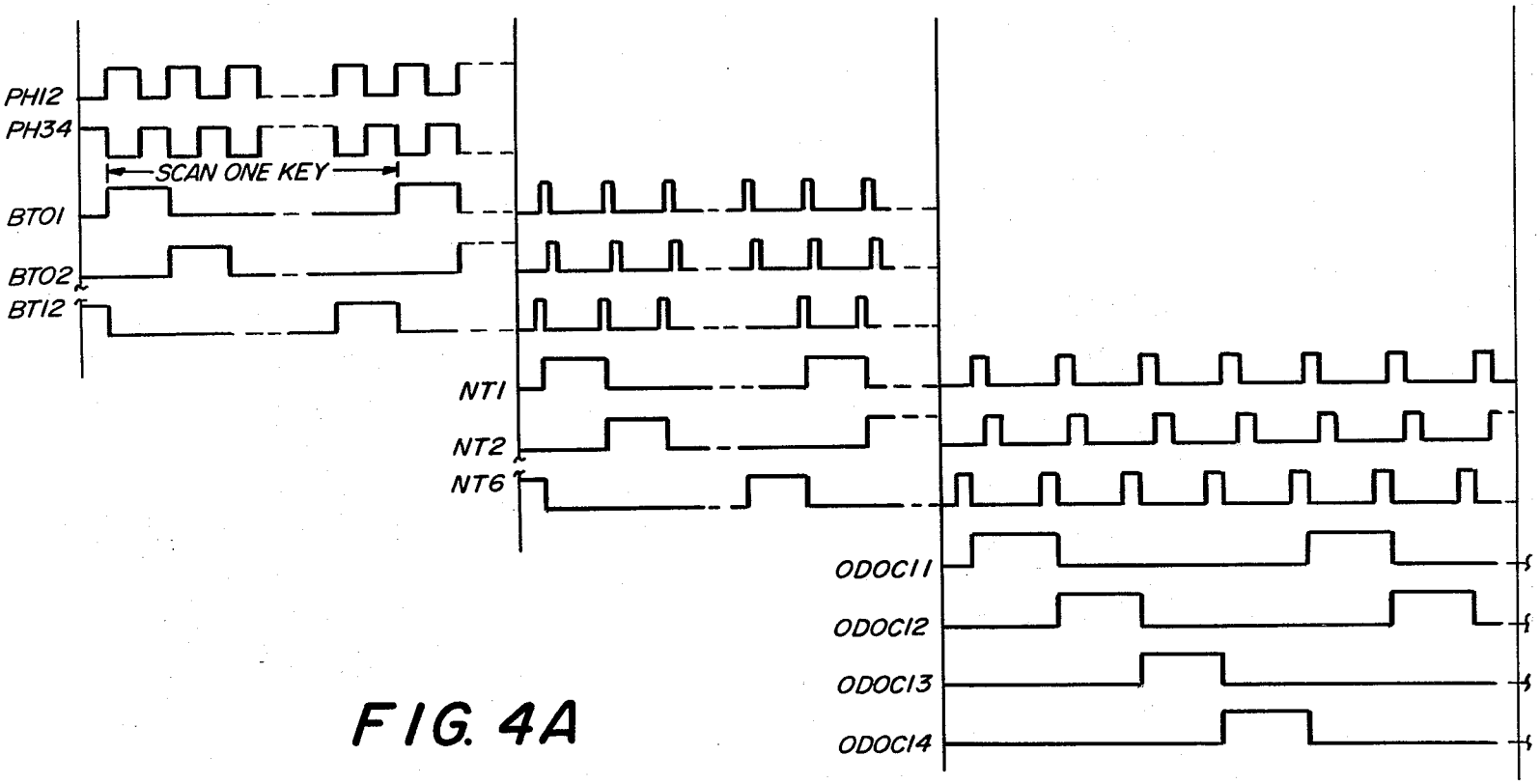
FIGS. 4A and 4B comprise a diagram showing the timing of the keyboard multiplexer signals identified in FIG. 2.
Figure 4B:
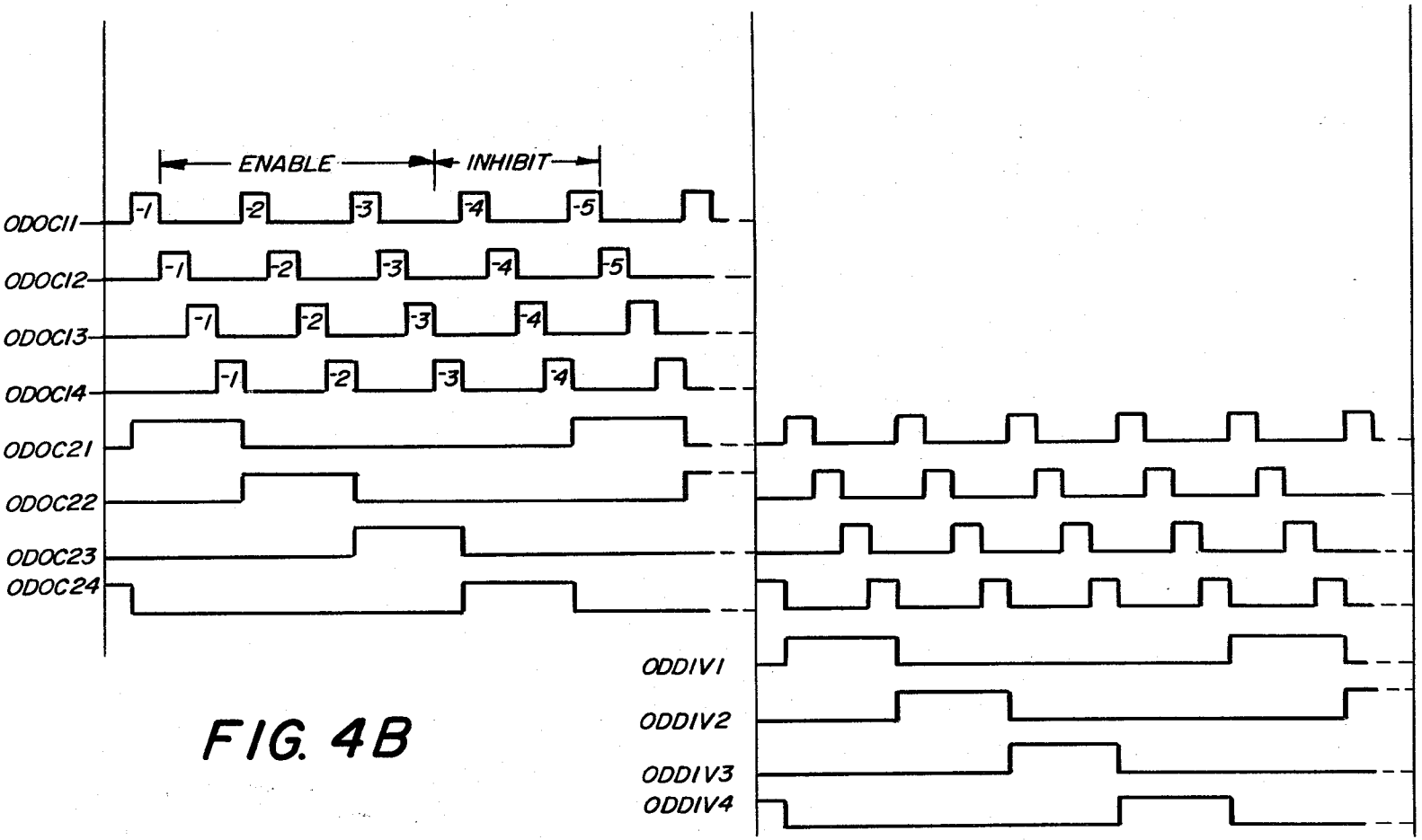

The time relationship between the above mentioned pulse signals is well known and is shown in FIGS. 4A and 4B. An explanation of the relationship between these signals is provided for the reader's convenience; but it should be understood that the relationship shown is only exemplary, the invention being adapted for use with any keyboard multiplexer. Likewise, the keyboard multiplexer shown in FIGS. 2 and 3 is only exemplary and does not restrict the scope of the invention.

Referring to FIG. 4A, the bit time signals BT01-BT12 are shown in relation to (and in the same time scale as) the master clock output signals PH12 and PH34. The output signals PH12 and PH34 are complements, and by way of example the frequency of each signal is 1 Mhz with a 50% duty cycle. The duration of each PH pulse is therefore ½ usec. The NT pulses are shown in relation to the BT pulses, the time scale of the BT pulses being compressed for purposes of illustration by a factor of 12. The half octave counter pulses ODOC11-ODOC14 are shown in relation to the NT pulses, the time scale of the NT pulses being compressed by a factor of 4. Referring to FIG. 4B, the two octave counter pulses ODOC21-ODOC24 are shown in relation to the half octave counter pulses, the time scale of the half octave counter pulses shown in FIG. 4A being compressed for purposes of illustration by a factor of 3. The division counter pulses ODD1-V1-ODD1V4 are shown in relation to the two octave counter pulses, the time scale of the two octave counter pulses being compressed for purposes of illustration by a factor of 4.

Referring to FIG. 3, the decoder 24 includes a series of 3 input AND gates, designated collectively as 32, each of which decodes a unique combination of the ODOC1X (where X=1-4), ODOC2X (where X=1-4), and ODD1VX (where X=1-4) signals to scan a corresponding column of key contacts or switches in the switching array 22. Altogether, there are 64 such AND gates, designated 32-1 through 32-64, in decoder 24. Each gate decodes the combinations of ODOC1X, ODOC2X and ODD1VX signals as indicated in Table 1 below.

TABLE 1

| AND Gate 32-X | ODOC1X | ODOC2X | ODD1VX |
|---|---|---|---|
| 1 | 1 | 1 | 1 |
| 2 | 2 | 1 | 1 |
| 3 | 3 | 1 | 1 |
| 4 | 4 | 1 | 1 |
| 5 | 1 | 2 | 1 |
| 6 | 2 | 2 | 1 |
| 7 | 3 | 2 | 1 |
| 8 | 4 | 2 | 1 |
| 9 | 1 | 3 | 1 |
| 10 | 2 | 3 | 1 |
| 11 | 3 | 3 | 1 |
| 12 | 4 | 3 | 1 |

TABLE 1-continued

| AND Gate 32-X | ODOC1X | ODOC2X | ODD1VX |
|---|---|---|---|
| 13 | 1 | 4 | 1 |
| 14 | 2 | 4 | 1 |
| 15 | 3 | 4 | 1 |
| 16 | 4 | 4 | 1 |
| 17 | 1 | 1 | 2 |
| 18 | 2 | 1 | 2 |
| 19 | 3 | 1 | 2 |
| 20 | 4 | 1 | 2 |
| 21 | 1 | 2 | 2 |
| 22 | 2 | 2 | 2 |
| 23 | 3 | 2 | 2 |
| 24 | 4 | 2 | 2 |
| 25 | 1 | 3 | 2 |
| 26 | 2 | 3 | 2 |
| 27 | 3 | 3 | 2 |
| 28 | 4 | 3 | 2 |
| 29 | 1 | 4 | 2 |
| 30 | 2 | 4 | 2 |
| 31 | 3 | 4 | 2 |
| 32 | 4 | 4 | 2 |
| 33 | 1 | 1 | 3 |
| 34 | 2 | 1 | 3 |
| 35 | 3 | 1 | 3 |
| 36 | 4 | 1 | 3 |
| 37 | 1 | 2 | 3 |
| 38 | 2 | 2 | 3 |
| 39 | 3 | 2 | 3 |
| 40 | 4 | 2 | 3 |
| 41 | 1 | 3 | 3 |
| 42 | 2 | 3 | 3 |
| 43 | 3 | 3 | 3 |
| 44 | 4 | 3 | 3 |
| 45 | 1 | 4 | 3 |
| 46 | 2 | 4 | 3 |
| 47 | 3 | 4 | 3 |
| 48 | 4 | 3 | 4 |
| 49 | 1 | 1 | 4 |
| 50 | 2 | 1 | 4 |
| 51 | 3 | 1 | 4 |
| 52 | 4 | 1 | 4 |
| 53 | 1 | 2 | 4 |
| 54 | 2 | 2 | 4 |
| 55 | 3 | 2 | 4 |
| 56 | 4 | 2 | 4 |
| 57 | 1 | 3 | 4 |
| 58 | 2 | 3 | 4 |
| 59 | 3 | 3 | 4 |
| 60 | 4 | 3 | 4 |
| 61 | 1 | 4 | 4 |
| 62 | 2 | 4 | 4 |
| 63 | 3 | 4 | 4 |
| 64 | 4 | 4 | 4 |

The switching array 22 is a 64×6 array comprising 64 columns and 6 rows. Each column is connected to an output of one of the AND gates 32. Each row is connected to one of six 2-input AND gates, denoted collectively as 34, in encoder 20. A series connected diode and key switch pair is connected between each row and each column of the array 22. Accordingly, there are 384 such diode-switch pairs (designated 36-1 through 36-384 in FIG. 3). Each switch is uniquely associated with a key of the instrument keyboard. Closure of a switch results from depression of the associated key.

One NTX signal (where X=1-6) and one switching array row signal RX (where X=1-6) are connected to the inputs of each of the AND gates 34. The AND gates 34 encode the combinations of the NTX and RX signals as indicated in Table 2 below.

TABLE 2

| AND gate 34-X | NTX | RX |
|---|---|---|
| 1 | 1 | 1 |
| 2 | 2 | 2 |
| 3 | 3 | 3 |

TABLE 2-continued

| AND gate 34-X | NTX | RX |
|---|---|---|
| 4 | 4 | 4 |
| 5 | 5 | 5 |
| 6 | 6 | 6 |

The outputs of AND gates 34-1 through 34-6 are connected to the inputs of a 6 input OR gate 38. The output of the OR gate 38 is the multiplexed keyboard pulse stream I4PLSE. The I4PLSE stream is used by the musical instrument to generate musical tones in a manner well known in the art.

Figure 5:
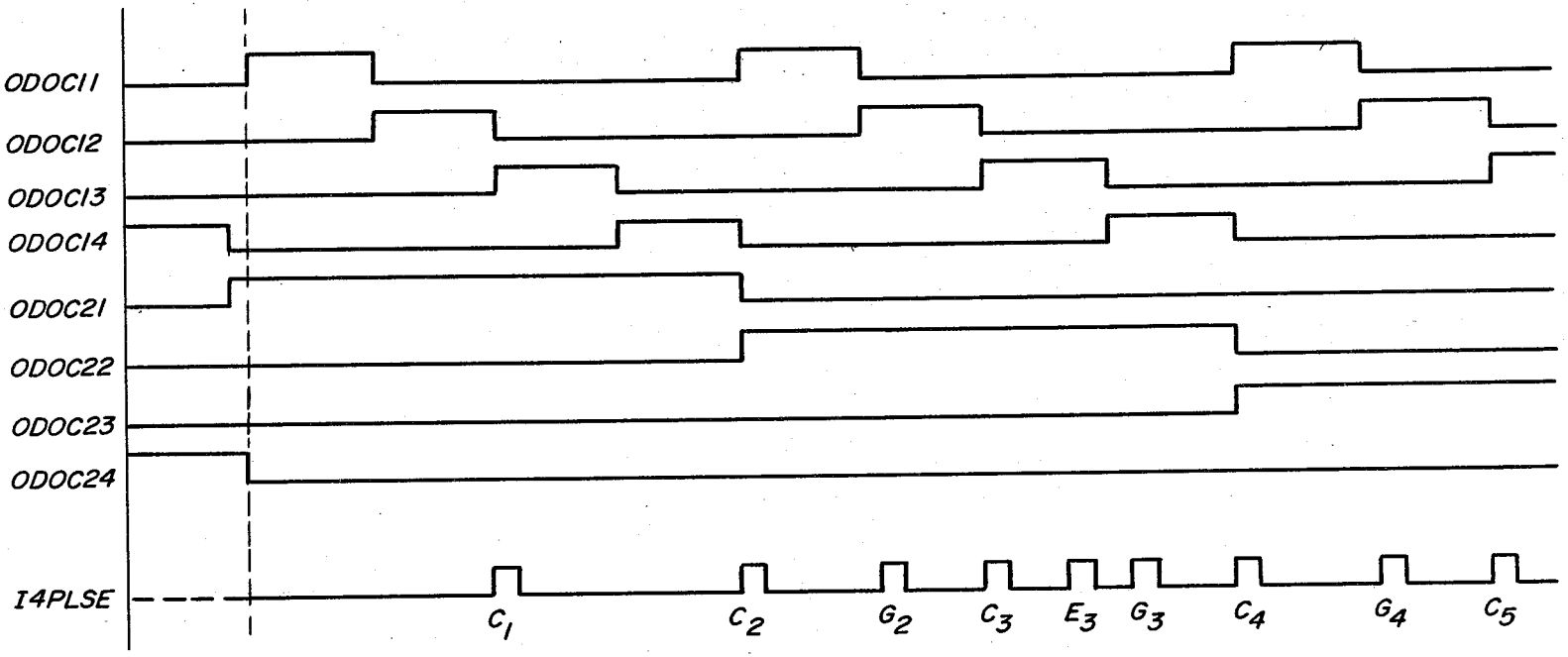
FIG. 5 is an exemplary diagram showing the timing of certain multiplexed keyboard pulses produced by depression of selected keys of the electronic musical instrument.

The time relationship between multiplexed keyboard pulses appearing on the I4PLSE line in response to depression of the keys corresponding to notes C1, C2, G2, C3, E3, G3, C4, G4, and C5 are shown during one keyboard scan in FIG. 5. The pulses correspond to keys played (depressed) on the keyboard division identified by one of the ODD1VX (where X=1 through 4) signals.

The exemplary keyboard multiplexer described above allows for the selection of many more keys than are actually desired or provided in the musical instrument. Thus, in the exemplary configuration described herein there are 96 keys/division of the keyboard, or 384 keys in total (four divisions). In actuality, only 62 keys/division (32 for the pedal division) or 215 keys are normally provided.

Figure 11:
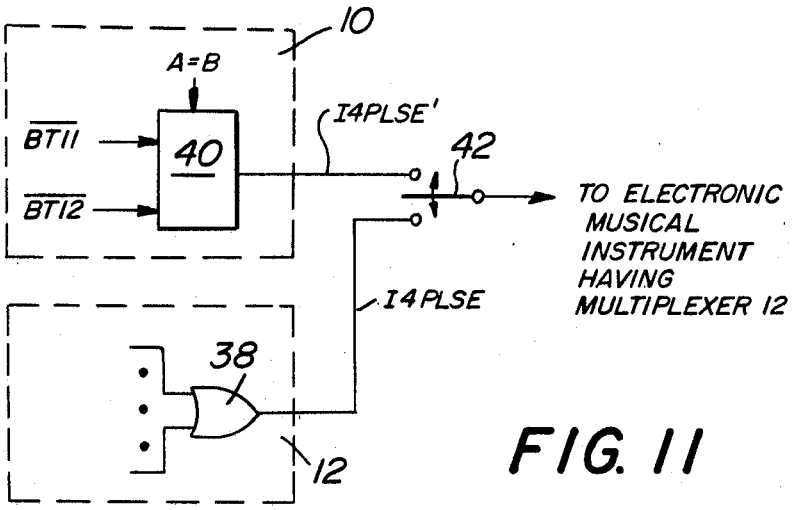
FIG. 11 is a segmented block diagram of the asynchronous interface coupled to a switch for selecting synthesized keyboard pulses or manually generated keyboard pulses for operation of the electronic musical instrument.

Reverting to FIG. 1, the asynchronous interface 10 includes a keyboard pulse synthesizer 40 which generates a (synthesized) serial pulse stream designated I4PLSE' which may be substituted for the pulse stream I4PLSE. This is accomplished by manual operation of a switch 42 (FIG. 11) from contact with the I4PLSE line to contact with the I4PLSE' line. Alternatively, the I4PLSE' pulse stream may be combined with the I4PLSE pulse stream by an OR gate 44 (FIG. 12) so that the musical instrument can be played simultaneously in response to the controlling device (computer or other data input device) and in response to manual operation of the instrument keyboard.

Operation of the Asynchronous Interface 10

Figure 6:
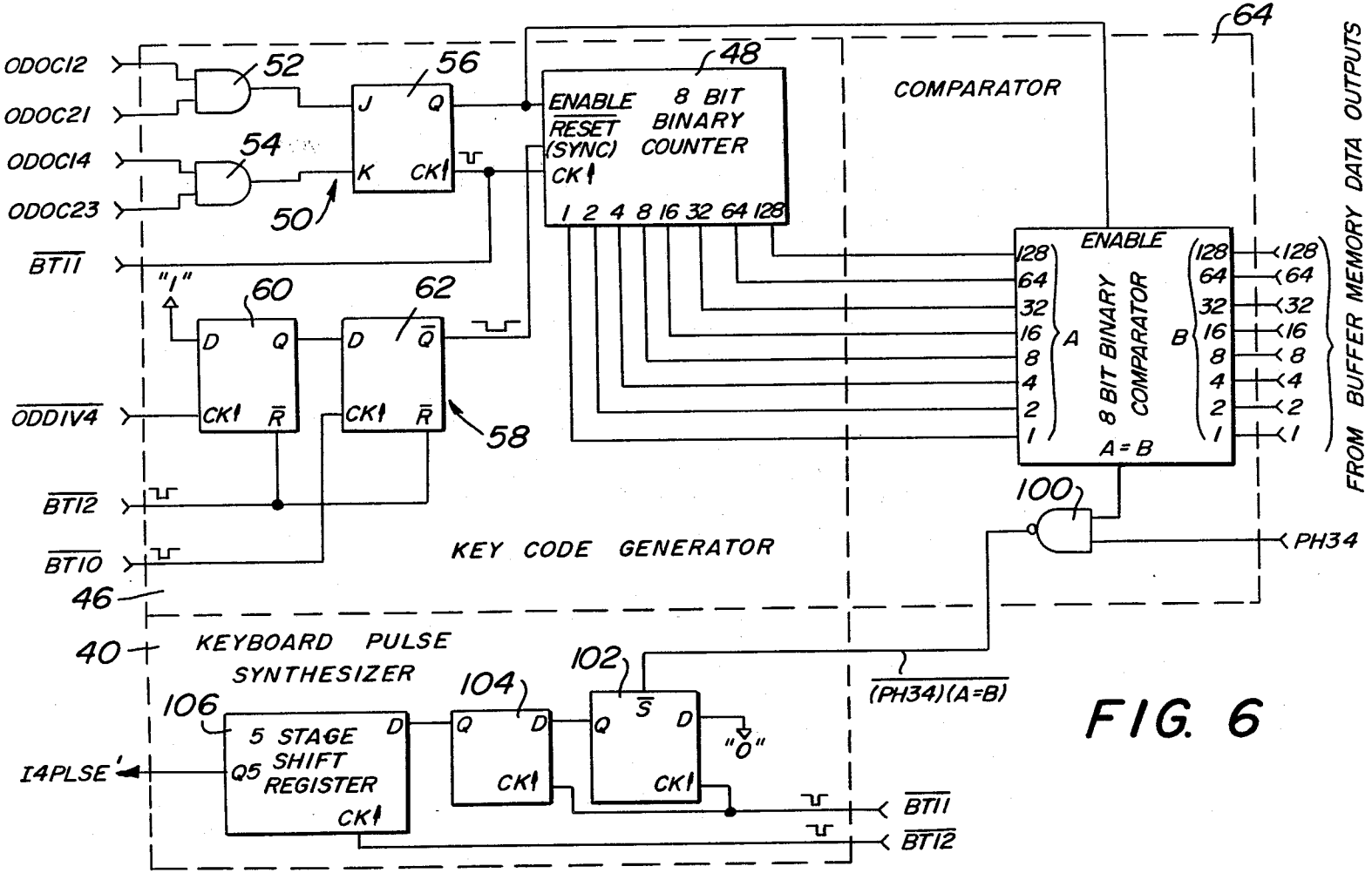
FIG. 6 is a schematic of the key code generator, comparator, and keyboard pulse synthesizer of the asynchronous interface in FIG. 1.

Referring to FIGS. 1 and 6, the asynchronous interface 10 includes a key code generator 46 comprising an 8 bit binary counter 48, a count enable circuit 50 (including AND gates 52 and 54 and JK flip-flop 56) and a reset count circuit 58 (including D-type flip-flops 60 and 62). The $\overline{BT11}$ pulse (complement of BT11 pulse) clocks the flip-flop 56 and the 8 bit counter 48.

A key on the instrument keyboard is scanned by the keyboard multiplexer between successive BT01 pulses (FIG. 4). A $\overline{BT11}$ pulse occurs during each key scan, between successive BT01 pulses, and the 8 bit binary counter 48 is advanced one count on the rising edge of each $\overline{BT11}$ pulse. Since a new key is being scanned each time that a $\overline{BT11}$ pulse occurs, a new number will be present at the output of counter 48 for each key. In this fashion, a unique 8 bit binary key code or number is assigned to each key of the instrument keyboard as the key is being scanned. This key number is then applied to to an 8 bit binary comparator 64, described in detail hereinafter.

The ODOC12 and ODOC21 signals are applied to the inputs of AND gate 52 in key code generator 46. The output of AND gate 52 is connected to the J input of a J-K flip-flop 56. The ODOC14 and ODOC23 signals are applied to the inputs of AND gate 54, the output of which is connected to the K input of flip-flop 56. When flip-flop 56 is clocked on the rising edge of the $\overline{BT11}$ pulse, the Q output of the flip-flop changes state based on the logic levels appearing at the J and K inputs as indicated in Table 3 below.

TABLE 3

| J | K | Q |
|---|---|---|
| 1 | 0 | 1 |
| 0 | 1 | 0 |

At the rising edge of the $\overline{BT11}$ pulse, when the ODOC12 and ODOC21 pulses are high (FIG. 4B), the Q output of flip-flop 56 will go high. And at the rising edge of the $\overline{BT11}$ pulse, when the ODOC14 and ODOC23 pulses are high, the Q output of flip-flop 56 will go low. The Q output of flip-flop 56, when high, enables the 8 bit binary counter 48, allowing it to count, and the 8 bit binary comparator 64, allowing it to generate an A=B output as described more fully hereinafter. When the Q output of flip-flop 56 is low, the 8 bit binary counter 48 and the 8 bit binary comparator 64 are inhibited.

By controlling the J and K inputs of flip-flop 56 in response to the ODOC12, ODOC21, ODOC14 and ODOC23 signals as described above, 60 keys per division may be controlled by the interface 10 during each keyboard scan. Thus, in the embodiment of the invention described herein, the Q output of flip-flop 56 is high (counter 48 and comparator 64 enabled) when a BT11 pulse is generated and the ODOC12 and ODOC21 signals are both high, and the Q output remains high until another BT11 pulse is generated and the ODOC14 and ODOC23 signals are both high. This corresponds to the time interval between the rising edge of the first ODOC12 pulse, ODOC12-1 (FIG. 4B), and the third ODOC14 pulse, ODOC14-3. The interval therefore includes 10 ODOC1X pulses (ODOC12-1, -2 and -3, ODOC13-1, -2 and 3, ODOC14-1 and -2, and ODOC11-2 and -3), corresponding to a scan of 10 half-octaves or (at 6 keys per half octave) 60 keys. From the rising edge of the third ODOC14 pulse, ODOC14-3, until the rising edge of the fifth ODOC12 pulse, ODOC12-5, the Q output of flip-flop 56 is low, inhibiting the counter 48 and comparator 64. This corresponds to 6 ODOC1X pulses (ODOC14-3 and -4, ODOC11-4 and -5, ODOC12-3 and ODOC13-4) or a scan of 6 half-octaves or 36 keys. Thus, only 60 of every 96 division keys (and there are 4 divisions) are utilized to control the musical instrument by the embodiment of the asynchronous interface described herein.

In general, an enable/inhibit signal (Q output of flip-flop 56) is generated if it is desired to limit the total number of key numbers or key codes generated by counter 48. Assuming that there are 96 keys/division and that the keyboard comprises 4 divisions, hence, 384 keys total, counter 48 would have to be a 9 bit counter to specify (9 bit) key numbers for all 384 keys. Gates 52, 54 and flip-flop 56 could then be eliminated, since it would not be necessary to inhibit counter 48 and comparator 64 (which would then be a 9 bit comparator). Since the controlling computer would most likely be an 8 bit machine (or some multiple thereof), however, an 8 bit key code would be more practical than a 9 bit code. Using an 8 bit key code, i.e., an 8 bit counter 48 and an 8 bit comparator 64, the counter is able to generate the key codes or numbers for a 60 key/division scheme (240 keys for 4 divisions) as described above. An allowance of 60 keys/division for control by the invention is sufficient for good performance. Since the scheme requires only 240 key numbers in total, 16 key numbers are available for use as special control codes in certain applications.

Reverting to FIG. 6, using the 60 key/division scheme, the enable signal allows the counter 48 and comparator 64 to be active (enabled) only when the keyboard multiplexer 12 is scanning 60 of the 96 keys in any of the 4 divisions. The counter and comparator are inhibited during the remaining portion of a scan of each division. The reset count circuit 58 includes flip-flops 60 and 62 which form a synchronous one-shot. The $\overline{Q}$ output of flip-flop 62 resets the 8 bit binary counter 48. The rising edge of the $\overline{\text{ODD1V4}}$ pulse clocks a "1" into flip-flop 60, causing its Q output to go high. The $\overline{\text{ODD1V4}}$ pulse goes high on the rising edge of a BT01 pulse (FIG. 4B). A $\overline{\text{BT10}}$ pulse occurs between successive BT01 pulses. The rising edge of the $\overline{\text{BT10}}$ pulse clocks the high output of flip-flop 60 into flip-flop 62, causing the $\overline{Q}$ output of flip-flop 62 to go low, initiating a reset pulse. The reset pulse appears at the $\overline{\text{RESET}}$ input of counter 48. The $\overline{\text{RESET}}$ input of the counter is synchronous, i.e. the counter is reset on the rising edge of the $\overline{\text{BT11}}$ pulse when the reset pulse appears at the $\overline{\text{RESET}}$ input of the counter. After the counter is reset, a $\overline{\text{BT12}}$ pulse is applied to the reset ($\overline{R}$) inputs of flip-flops 60 and 62, terminating the reset pulse ($\overline{Q}$ output of flip-flop 62). The reset operation takes place when the enable signal is low (when the counter 48 is inhibited). Thus, counter 48 is reset after all divisions have been scanned, as indicated by the rising edge of $\overline{\text{ODD1V4}}$. Each time any given key is scanned, the counter will contain one unique number which specifies the key code or number assigned to that key.

A typical 60 key/division scheme (4 divisions, 240 keys) is illustrated in Table 4 below where ODD1V1 corresponds to the Choir division, ODD1V2 corresponds to the Swell division, ODD1V3 corresponds to the Great division, and ODD1V4 corresponds to the Pedal division, the 240 key codes or numbers being given in hexadecimal notation.

TABLE 4

| KEY | CHOIR | DIVISION SWELL | GREAT | PEDAL |
|---|---|---|---|---|
| $C_1$ | 00 | 3C | 78 | B4 |
| $C\#_1$ | 01 | 3D | 79 | B5 |
| $D_1$ | 02 | 3E | 7A | B6 |
| $D\#_1$ | 03 | 3F | 7B | B7 |
| $E_1$ | 04 | 40 | 7C | B8 |
| $F_1$ | 05 | 41 | 7D | B9 |
| $F\#_1$ | 06 | 41 | 7E | BA |
| $G_1$ | 07 | 43 | 7F | BB |
| $G\#_1$ | 08 | 44 | 80 | BC |
| $A_1$ | 09 | 45 | 81 | BD |
| $A\#_1$ | 0A | 46 | 82 | BE |
| $B_1$ | 0B | 47 | 83 | BF |
| $C_2$ | 0C | 48 | 84 | C0 |
| $C\#_2$ | 0D | 49 | 85 | C1 |
| $D_2$ | 0E | 4A | 86 | C2 |
| $D\#_2$ | 0F | 48 | 87 | C3 |
| $E_2$ | 10 | 4C | 88 | C4 |
| $F_2$ | 11 | 4D | 89 | C5 |
| $F\#_2$ | 12 | 4E | 8A | C6 |
| $G_2$ | 13 | 4F | 8B | C7 |
| $G\#_2$ | 14 | 50 | 8C | C8 |
| $A_2$ | 15 | 51 | 8D | C9 |
| $A\#_2$ | 16 | 52 | 8E | CA |
| $B_2$ | 17 | 53 | 8F | CB |
| $C_3$ | 18 | 54 | 90 | CC |
| $C\#_3$ | 19 | 55 | 91 | CD |

TABLE 4-continued

| KEY | CHOIR | DIVISION SWELL | GREAT | PEDAL |
|---|---|---|---|---|
| $D_3$ | 1A | 56 | 92 | CE |
| $D\#_3$ | 1B | 57 | 93 | CF |
| $E_3$ | 1C | 58 | 94 | D0 |
| $F_3$ | 1D | 59 | 95 | D1 |
| $F\#_3$ | 1E | 5A | 96 | D2 |
| $G_3$ | 1F | 5B | 97 | D3 |
| $G\#_3$ | 20 | 5C | 98 | D4 |
| $A_3$ | 21 | 5D | 99 | D5 |
| $A\#_3$ | 22 | 5E | 9A | D6 |
| $B_3$ | 23 | 5F | 9B | D7 |
| $C_4$ | 24 | 60 | 9C | D8 |
| $C\#_4$ | 25 | 61 | 9D | D9 |
| $D_4$ | 26 | 62 | 9E | DA |
| $D\#_4$ | 27 | 63 | 9F | DB |
| $E_4$ | 28 | 64 | A0 | DC |
| $F_4$ | 29 | 65 | A1 | DD |
| $F\#_4$ | 2A | 66 | A2 | DE |
| $G_4$ | 2B | 67 | A3 | DF |
| $G\#_4$ | 2C | 68 | A4 | E0 |
| $A_4$ | 20 | 69 | A5 | E1 |
| $A\#_4$ | 2E | 6A | A6 | E2 |
| $B_4$ | 2F | 6B | A7 | E3 |
| $C_5$ | 30 | 6C | A8 | E4 |
| $C\#_5$ | 31 | 6D | A9 | E5 |
| $D_5$ | 32 | 6E | AA | E6 |
| $D\#_5$ | 33 | 6F | AB | E7 |
| $E_5$ | 34 | 70 | AC | E8 |
| $F_5$ | 35 | 71 | AD | E9 |
| $F\#_5$ | 36 | 72 | AE | EA |
| $G_5$ | 37 | 73 | AF | EB |
| $G\#_5$ | 38 | 74 | B0 | EC |
| $A_5$ | 39 | 75 | B1 | ED |
| $A\#_5$ | 3A | 76 | B2 | EE |
| $B_5$ | 3B | 77 | B3 | EF |

The key numbers or notations adopted in Table 4 above are given by way of example only, and do not in any way restrict the assignment of key numbers. When the ODD1V1 pulse is high, the Choir division is selected and the lowest key or note on this division is assigned the key number 00 ($C_1$). The assignment of key numbers by counter 48 continues and repeats indefinitely as the keyboard divisions are repetitively scanned by the keyboard multiplexer. The means by which the selection of keys and synthesis of keyboard pulses is correlated with the above key numbers is described in detail hereinafter.

Figure 7:
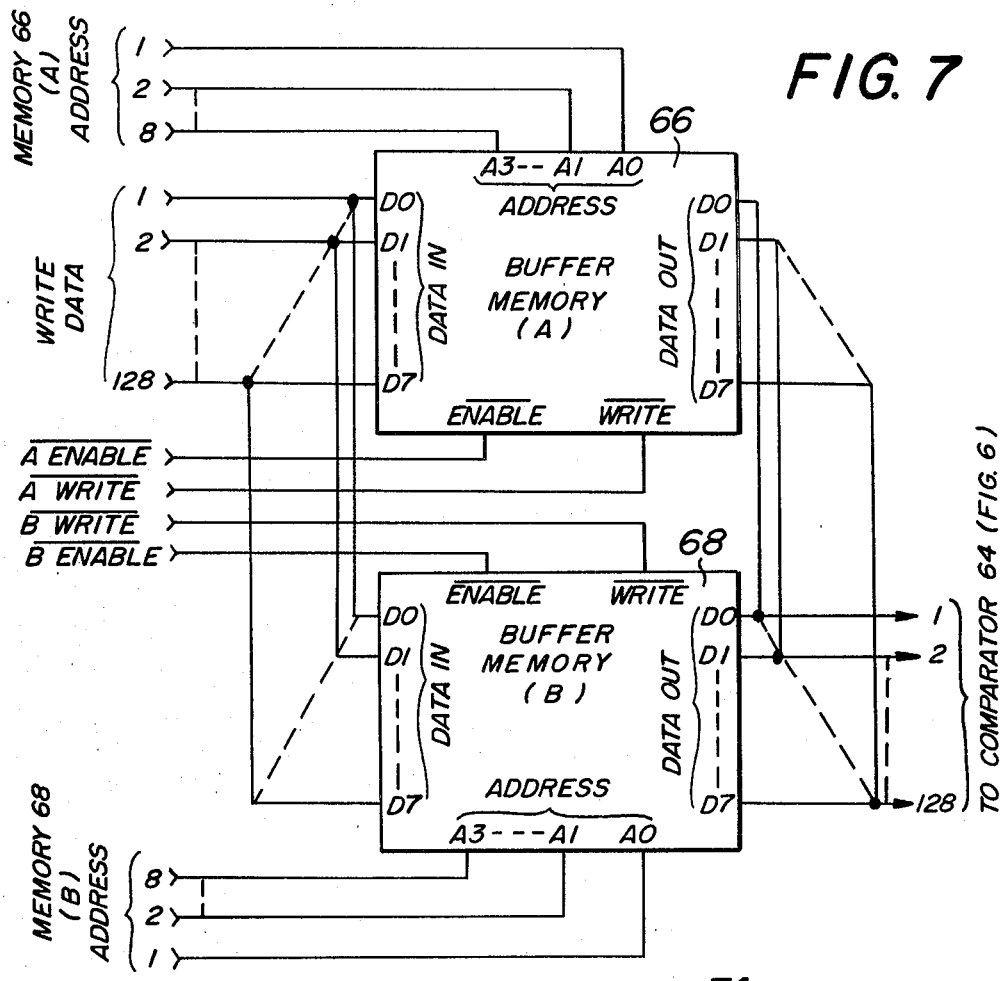
FIG. 7 is a schematic of the buffer memories of the asynchronous interface in FIG. 1.

Referring to FIGS. 1 and 7, the asynchronous interface includes two 12×8 buffer memories (RAMs) 66 and 68. Each memory has its own $\overline{\text{DATA}}$ inputs and outputs, ADDRESS inputs, $\overline{\text{ENABLE}}$ input and $\overline{\text{WRITE}}$ input. The DATA outputs (D0–D7) of each memory are physically separated from its DATA inputs (D0–D7). The data outputs of both memories are bussed together in pairs on a common output bus which is connected to the B inputs of the 8 bit binary comparator 64 (FIG. 6). As described hereinafter, a read/write controller 72 (FIG. 9) ensures that the DATA outputs of only one buffer memory are electrically connected to the B inputs of comparator 64 at any given time.

The functions of the control inputs of each memory, designated $\overline{\text{ENABLE}}$ and $\overline{\text{WRITE}}$, are given in Table 5 below:

TABLE 5

| $\overline{\text{ENABLE}}$ | $\overline{\text{WRITE}}$ | FUNCTION |
|---|---|---|
| 0 | 0 | WRITE (DATA outputs open or high impedance) |
| 0 | 1 | READ (DATA outputs active) |
| 1 | X | DISABLED (DATA outputs open or |

TABLE 5-continued

| ENABLE | WRITE | FUNCTION |
|---|---|---|
| | | high impedance) |

Figure 8:
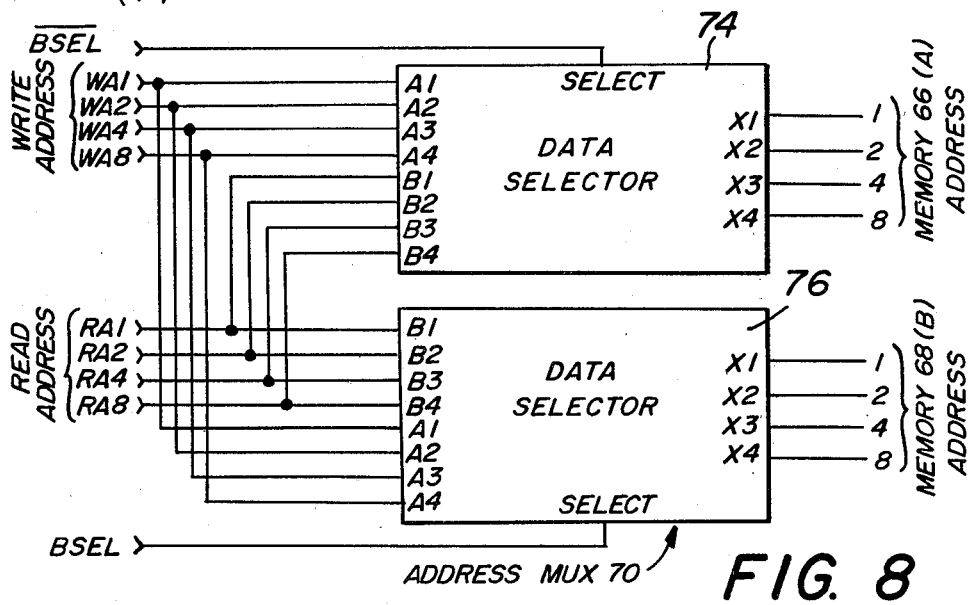
FIG. 8 is a schematic of the address multiplexer circuit of the asynchronous interface in FIG. 1.

Referring to FIGS. 1 and 7, each buffer memory 66, 68 may comprise two 74189, 16×4 bipolar RAMs configured as a 16×8 memory, address locations in excess of the required 12×8 locations not being used. The parallel data inputs, WRITE DATA, come from the controlling computer and are connected in pairs to the DATA inputs of both buffer memories. As used herein, the term "computer" means any device or group of devices capable of addressing and writing data into a RAM, i.e., any device(s) that can generate appropriate address, data, and read/write signals. The address inputs, designated MEMORY A and B ADDRESS, come from the address mux (multiplexer) circuit 70 (FIG. 8). The read/write control inputs A and B $\overline{\text{ENABLE}}$ and A and B $\overline{\text{WRITE}}$, come from the read/write controller 72 (FIG. 9).

Referring to FIGS. 1 and 8, the address multiplexer circuit 70 comprises two data selector devices 74 and 76 which determine the address source for each of the buffer memories 66, 68 (FIG. 7). The outputs X1–X4 of each device 74, 76 are connected respectively to the address inputs A0–A3 of the associated buffer memory 66, 68. The inputs A1–A4 of both devices are connected together to the WRITE ADDRESS lines WA1, 2, 4 and 8 from the computer. The inputs B1–B4 of both devices are connected together to the READ ADDRESS lines RA1, 2, 4 and 8 from the read address generator 78 (FIG. 9).

For each device 74, 76, when the SELECT input is high, lines A1–A4 are connected respectively to lines X1–X4; and then the SELECT input is low, lines B1–B4 are connected to lines X1–X4. The SELECT input of device 76 is connected to the BSEL line, and the SELECT input of device 74 is connected to the $\overline{\text{BSEL}}$ line. Both the BSEL and $\overline{\text{BSEL}}$ lines are from the read/write controller 72 (FIG. 9). The BSEL and $\overline{\text{BSEL}}$ signals are complement logic signals. Accordingly, one buffer memory 66 (or 68) receives the READ ADDRESS RA1, 2, 4, 8 when the other buffer memory 68 (or 66) receives the WRITE ADDRESS WA1, 2, 4, 8.

Figure 9:
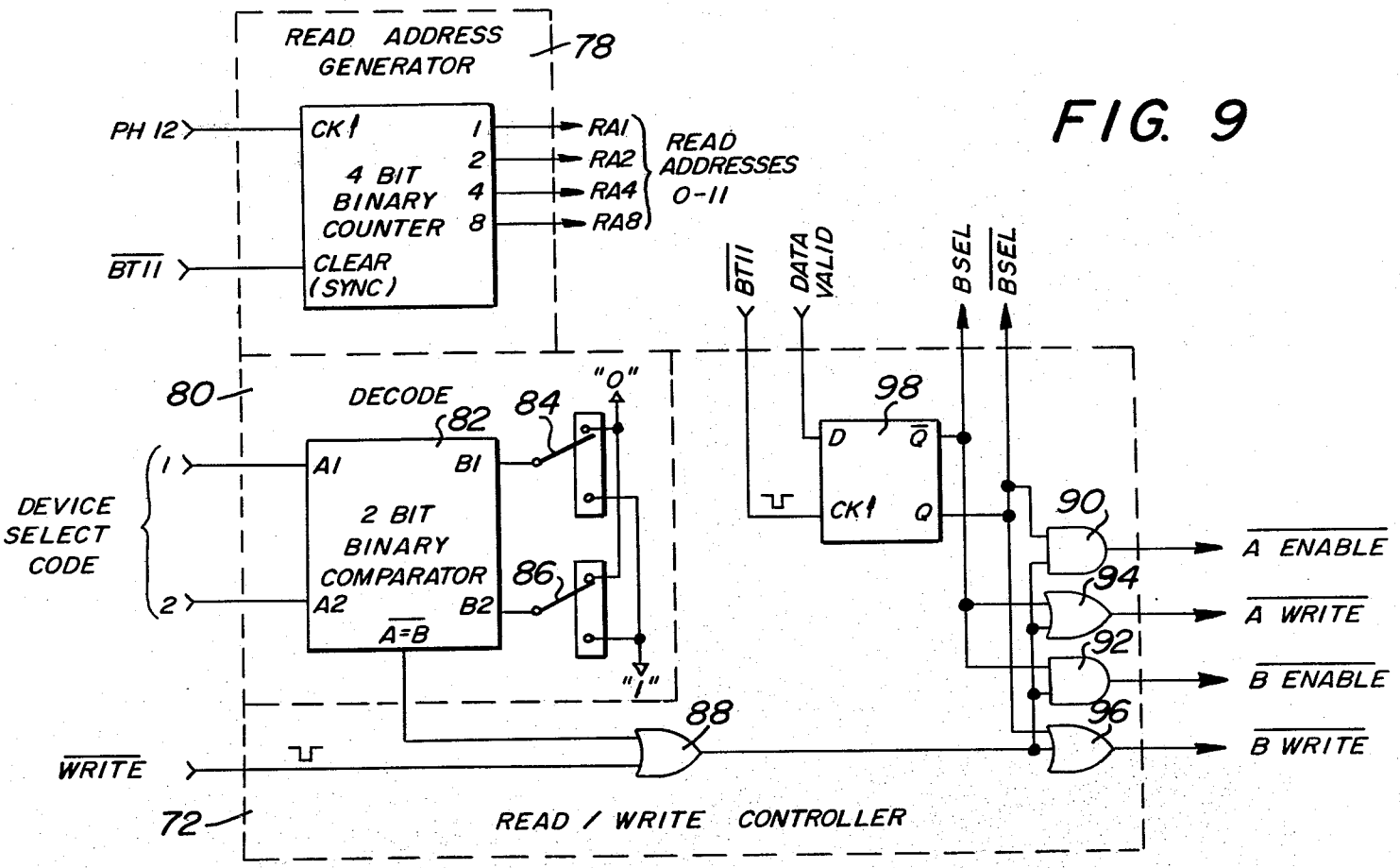
FIG. 9 is a schematic of the read address generator, decode circuit, and read/write controller of the asynchronous interface in FIG. 1.

Referring to FIGS. 1 and 9, a read address generator 78 generates READ ADDRESSES 0–11, each address comprising bits RA1, 2, 4, 8. Generator 78 is a 4 bit binary counter whose count is advanced on the rising edge of the PH12 pulse generated by the keyboard multiplexer master clock 14 (FIG. 2). The generator 78 is reset synchronously by the $\overline{\text{BT11}}$ signal i.e. on the rising edge of the PH12 pulse during a $\overline{\text{BT11}}$ pulse. Thus, the count maintained by generator 78 is returned to binary zero at the occurrence of a BT12 pulse. The generator 78 therefore counts 0–11, one count for each of the twelve BT pulses occurring between successive $\overline{\text{BT11}}$ pulses, or twelve counts during the period that each key is scanned.

In the preferred embodiment herein, it is assumed that plural musical instruments, each having a keyboard multiplexer, are controlled by a single computer by providing an asynchronous interface for each instrument. It is also assumed that independent control of each instrument is desired so that each interface is provided with a decode circuit 80. The read/write controller 72 is connected to the decode circuit 80. The decode circuit 80 includes a 2 bit binary comparator 82 whose inputs A1, A2 are a two bit DEVICE SELECT code from the computer and whose inputs B1, B2 are connected to the commons of two single pole double throw switches 84, 86. The switches allow the B1, B2 inputs to be connected to either logic "1" or logic "0" in one of four possible combinations. The setting of switches 84, 86 determines the identifying code of the interface 10. The A=B output of the comparator 82 goes low when the DEVICE SELECT code from the computer matches the identifying code set by switches 84, 86. The A=B output of the comparator 82 is connected to the read/write controller 72. If the A=B output is low, it allows the asynchronous interface 10 to accept key data from the computer. If the A=B output is high, the asynchronous interface is prevented from receiving key data from the computer.

For a two bit DEVICE SELECT code, decode circuit 80 allows up to four asynchronous interfaces to share one set of computer lines ($\overline{\text{WRITE}}$, DATA VALID, WRITE ADDRESS, WRITE DATA). Of course, the DEVICE SELECT code need not be limited to two bits. Thus, more than four asynchronous interfaces may be multiplexed on a single set of computer lines by increasing the number of bits in the DEVICE SELECT code and by using a like number of switches to set the identifying code of an interface. When using a single set of computer lines, all interfaces assigned the same DEVICE SELECT code will receive the same computer output signals simultaneously. Any interface will ignore all computer output signals (intended for other interfaces) when receiving a DEVICE SELECT code different from its assigned code.

The $\overline{\text{A=B}}$ output of the comparator 82 is connected to an OR gate 88 in the read/write controller 72 (FIG. 9). The read/write controller 72 generates A and B $\overline{\text{ENABLE}}$ and A and B $\overline{\text{WRITE}}$ signals which control the buffer memories 66, 68. The $\overline{\text{WRITE}}$ signal from the computer is ORed by gate 88 with the $\overline{\text{A=B}}$ output of the decode circuit 80 so that data can only be transferred from the computer to the interface 10 when the correct DEVICE SELECT code (the DEVICE SELECT code assigned to the interface) is present at the A1, A2 inputs of comparator 82. As previously mentioned, this occurs when the $\overline{\text{A=B}}$ line is low.

When the $\overline{\text{A=B}}$ line is high, the $\overline{\text{WRITE}}$ pulse (low or negative going pulse) will not appear at the output of gate 88. The output of gate 88 is connected to one input of each of two AND gates 90, 92 and each of two OR gates 94, 96. The output of gate 88 indirectly controls the operation of the buffer memories 66, 68 by directly controlling the A and B $\overline{\text{ENABLE}}$ and A and B $\overline{\text{WRITE}}$ signals.

It should be appreciated that the decode circuit 80 can be dispensed with, together with OR gate 88, and the $\overline{\text{WRITE}}$ signal from the computer can be transmitted directly to gates 90, 92 and 96 if (1) it is desired to operate plural instruments in unison, each instrument being associated with an asynchronous interface, and all such interfaces being connected in parallel to the same (single) set of computer output lines, there being only one $\overline{\text{WRITE}}$ pulse signal, or (2) if it is desired to independently control operation of the instruments and the computer is provided with different sets of output lines for each interface associated with each instrument, i.e. each interface receiving a different $\overline{\text{WRITE}}$ signal.

The A and B ENABLE and A and B WRITE signals are also controlled by the $\overline{\text{BT11}}$, DATA VALID and BSEL and $\overline{BSEL}$ signals. The DATA VALID signal is generated by the computer. The completion of the transfer of a block of data (WRITE DATA), i.e. twelve key numbers, from the computer to the asynchronous interface is signaled by a transition on the DATA VALID line (high to low or low to high). See FIGS. 14A and 14B. The DATA VALID signal is applied to the D input of a flip-flop 98 and is clocked in on the rising edge of the $\overline{BT11}$ pulse. See FIG. 9. The flip-flop 98 synchronizes the exchange of read/write operations of buffer memories 66, 68 with other operations taking place simultaneously in the invention as described hereinafter. The Q output of flip-flop 98 is the BSEL signal and is applied to the remaining inputs of gates 92 and 94 (FIG. 9) and to the data selector device 76 (FIG. 8). The $\overline{Q}$ output of flip-flop 98 is the $\overline{BSEL}$ signal and is applied to the remaining inputs of gates 90 and 96 and to the other data selector device 7A (FIG. 8).

Assuming that the asynchronous interface 10 receives the DEVICE SELECT code assigned to it, the $\overline{A=B}$ output of the comparator 82 is low, (FIG. 9) and the OR gate 88 passes the $\overline{WRITE}$ pulse to gates 90, 92, 94 and 96 which generate the A and B $\overline{ENABLE}$ and A and B $\overline{WRITE}$ signals to control the buffer memories 66 and 68 as indicated in Table 6 below:

TABLE 6

| $\overline{BSEL}$ | $\overline{WRITE}$ | $\overline{A}$ ENABLE | $\overline{A}$ WRITE | $\overline{B}$ ENABLE | $\overline{B}$ WRITE | BUFFER MEMORY 66 | BUFFER MEMORY 68 |
|---|---|---|---|---|---|---|---|
| 0 | 0 | 0 | 1 | 0 | 0 | READ | WRITE |
| 0 | 1 | 0 | 1 | 1 | 1 | READ | DISABLED |
| 1 | 0 | 0 | 0 | 0 | 1 | WRITE | READ |
| 1 | 1 | 1 | 1 | 0 | 1 | DISABLED | READ |

It should be noted that the read and write functions of memories 66, 68 are complementary, that is, data is read from one memory while data is being written into the other memory. The "polarity" (logic level 0 or 1) of the DATA VALID line determines the "polarity" of the BSEL and $\overline{BSEL}$ lines, hence, the particular memory which is being read from or written into. In effect, the DATA VALID line, synchronized at the $\overline{BT11}$ pulse, is a memory swapping signal.

Referring to FIG. 1, the preferred embodiment of the asynchronous interface 10 of the present invention described herein is designed to interface with a computer (or other external data input device) which generates data, address and control signals as described above, namely, key data in the form of twelve 8 bit key numbers (WRITE DATA), address signals in the form of twelve 4 bit storage address (binary 0–11) for each of the twelve key numbers being written into memory (WRITE ADDRESSES), a 2 bit interface select address (DEVICE SELECT code) for each of four possible asynchronous interfaces, and control signals in the form of write pulses $\overline{WRITE}$ that write each of the twelve 8 bit binary key numbers into their respective 4 bit addresses in a buffer memory, and a DATA VALID signal to indicate that the computer has completed transmission of one block of key numbers into the buffer memory. The number of addresses, bits, key numbers, interfaces, etc., need not be limited to those values given above, the above values being chosen merely by way of example.

The computer first generates an interface select address (DEVICE SELECT code), an 8 bit key number (WRITE DATA) and its associated 4 bit address (WRITE ADDRESS). After these outputs have stabilized and the set-up time of the memory (RAM) selected from writing has passed, the computer generates the $\overline{WRITE}$ pulse. See FIGS. 14A and 14B. The width of the WRITE PULSE is fixed by the computer and depends on the type of RAM being used. After completion of a data transfer, the computer causes the DATA VALID signal to change state. There is at least one $\overline{BT11}$ period bracketing a transition on the DATA VALID line to allow synchronization of the DATA VALID signal to the $\overline{BT11}$ pulse by flip-flop 98 (FIG. 9).

Assuming that the computer is inactive, i.e., that it is engaged in other tasks and is not addressing the asynchronous interface 10, the $\overline{BSEL}$ signal and the DATA VALID line are low, the $\overline{WRITE}$ line is high (no pulse) and buffer memory 66 contains valid key data (key numbers). Buffer memory 66 is in the read mode and buffer memory 68 is disabled (with high impedance outputs) since no $\overline{WRITE}$ pulse is generated. See Table 6 above. The READ ADDRESS (bits RA-1, -2, -4, -8) from the read address generator 78 (FIG. 9) is gated through data selector 74 (FIG. 8) and is applied to the ADDRESS (A0–A3) inputs of buffer memory 66 (FIG. 7). The read address generator 78, being clocked by PH12 and being reset by $\overline{BT11}$, counts 0–11 between each $\overline{BT11}$ pulse. Thus, in the period between each $\overline{BT11}$ pulse, as many as twelve 8 bit key numbers are read from memory 66 and are applied sequentially to the B inputs of the 8 bit binary comparator 64 (FIG. 6). The 8 bit binary counter 48 (FIG. 6) is clocked by $\overline{BT11}$ so that it counts at 1/12 the rate at which read address generator 78 (FIG. 9) generates READ ADDRESSES 0–11. This allows all twelve key numbers (READ DATA) read from buffer memory to be compared by comparator 64 (FIG. 6) with a key number generated during the keyboard multiplexing cycle (output of counter 48). If a match occurs, the A=B output of the comparator 64 goes high. The A=B signal is gated by a PH34 pulse through a NAND gate 100 (FIG. 6) which inverts the A=B signal. This gating prevents spurious signals caused by a change in the comparator 64 inputs from being passed to the keyboard pulse synthesizer 40.

The keyboard pulse synthesizer 40 includes D-input flip-flops 102 and 104 and a 5 stage shift register 106. The $\overline{(PH34)(A=B)}$ signal (output of gate 100) is applied to the $\overline{S}$ (set) input of flip-flop 102. The D input of flip-flop 102 is tied to binary 0 (low level) so that the flip-flop is reset (Q output low) by each $\overline{BT11}$ pulse. If the $\overline{(PH34)}$ $\overline{(A=B)}$ output of gate 100 goes low, it sets flip-flop 102 (Q output high). This occurs at the rising edge of a PH34 pulse, in between successive BT11 pulses, when a match occurs between one of the key numbers (B input of comparator 64) read from buffer memory 66 or 68 and the key number generated by counter 48 (A inputs of comparator 64).

Figure 13:
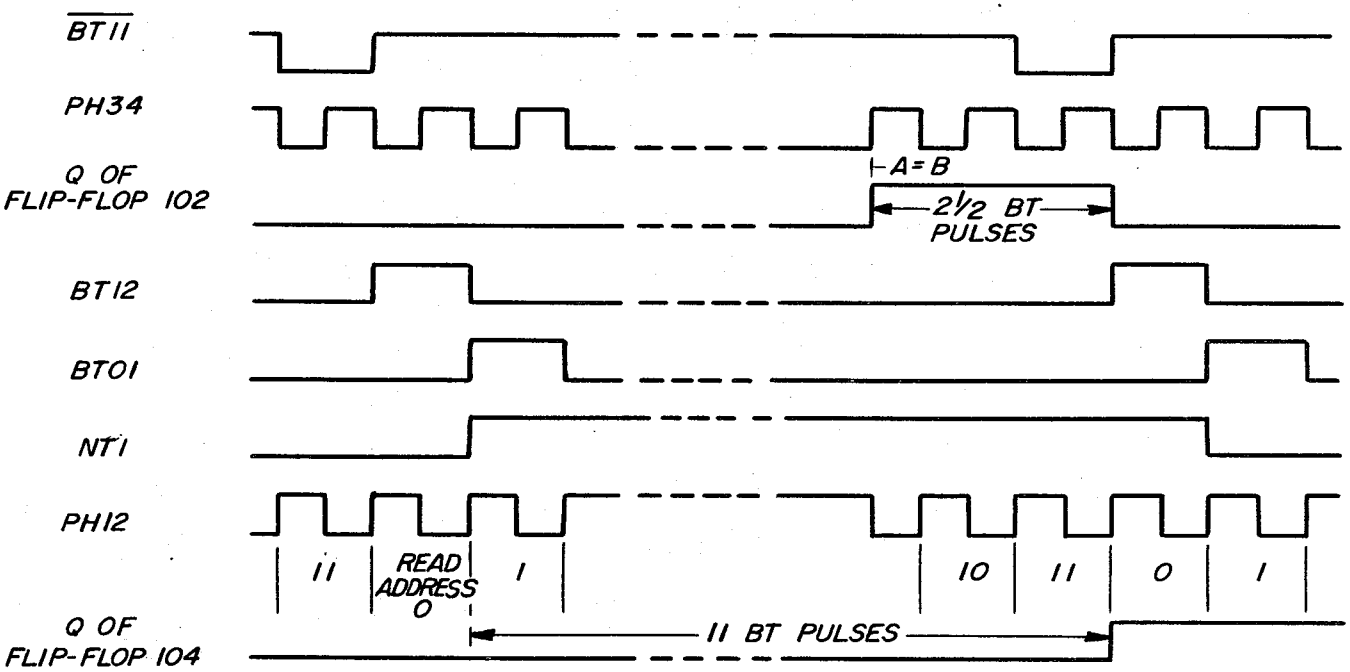
FIG. 13 is a diagram showing the timing of certain keyboard pulse synthesizer signals and relevant keyboard multiplexer signals.

Successive key numbers are generated by counter 48 at the $\overline{BT11}$ pulse rate. In between successive key numbers generated by the counter 48, i.e., in between successive $\overline{BT11}$ pulses, twelve key numbers (READ DATA) are read at the PH12 pulse rate, in sequence, from buffer memory 66 or 68 and are transmitted to comparator 64. Thus, as previously described, counter 48 (FIG. 6) is clocked at 1/12 the rate of read address generator 78 (FIG. 9). Accordingly, when flip-flop 102 is set, the Q output of the flip-flop may remain high for ½ to 11½ BT pulses, in increments of 1 BT pulse, depending on which of the twelve key numbers read from the buffer memory creates the match condition. In FIG. 13, there is shown a representative example of the timing for resetting and setting flip-flop 102 between successive $\overline{BT11}$ pulses. In the example chosen, a match occurs at READ ADDRESS 9 and the Q output of flip-flop 102 is set (high) for 2½ BT pulses. Flip-flop 104 converts the flip-flop 102 Q output pulse into a pulse having a twelve BT pulse width (or 1 NT pulse width) which is the width of a keyboard pulse I4PLSE.

More specifically, with reference to FIG. 13, the rising edge of a $\overline{BT11}$ pulse clocks the Q output of flip-flop 102 into flip-flop 104. The BT11 pulse also clocks a "0" into flip-flop 102, resetting the flip-flop (Q output low), and preparing it to receive future (PH34) ($\overline{A=B}$) inputs. The rising edge of the next $\overline{BT11}$ pulse clocks the low Q output of flip-flop 102 into flip-flop 104 so that the Q output of flip-flop 104 remains high for 12 BT pulses (1 NT pulse width), i.e. the interval between the rising edges of successive $\overline{BT11}$ pulses. The I4PLSE' pulse width is thus corrected to the length of a normal I4PLSE.

The I4PLSE' pulse must also appear in the synthesized keyboard multiplexer data stream at the proper time, i.e. in synchronism with the I4PLSE stream. An I4PLSE pulse begins and ends on the rising edges of BT01 pulses (see FIGS. 4A, 4B and 5). Accordingly, the rising edge of a $\overline{BT12}$ pulse (which corresponds to the rising edge of a BT01 pulse) clocks the pulses from the Q output of flip-flop 104 into the 5 stage shift register 106 and also shifts the pulses through the register. The output of the register 106 is a stream of I4PLSE' pulses that are indistinguishable from the I4PLSE pulses generated normally by the keyboard multiplexer (through key closures).

Figure 15:
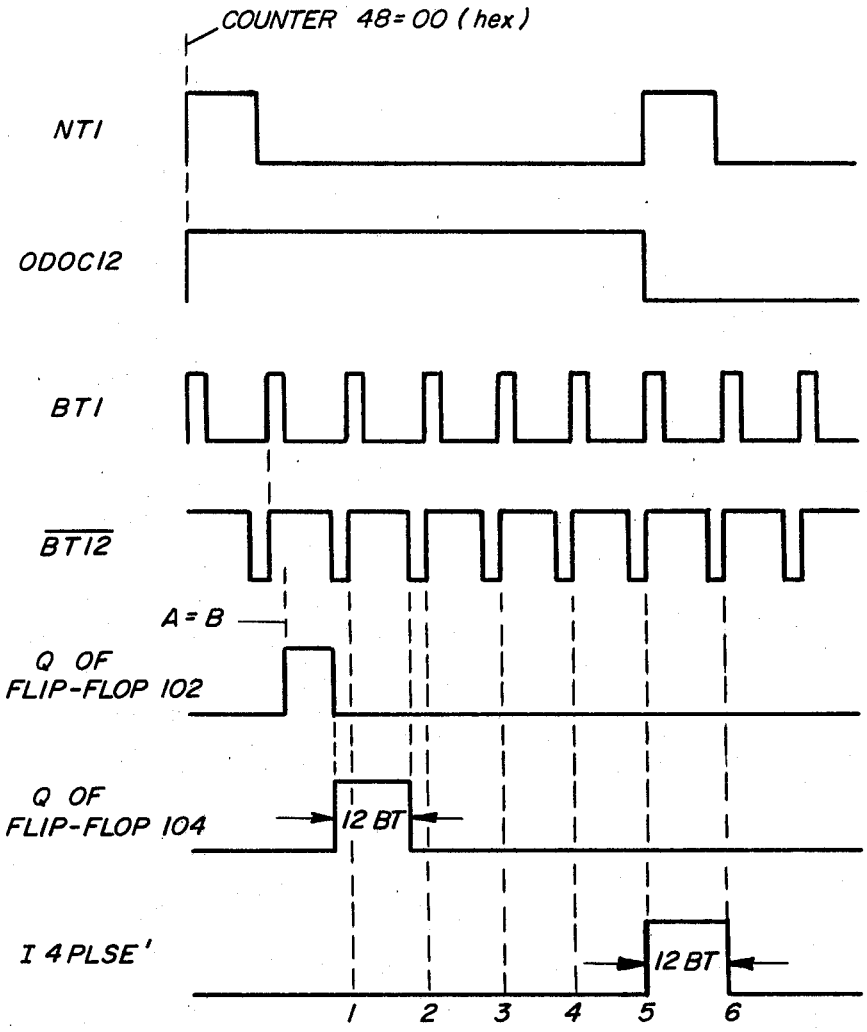
FIG. 15 is a diagram showing the timing of the keyboard pulse synthesizer and key code generator signals.

More specifically, referring to FIG. 15, the Q output of flip-flop 104 is delayed five $\overline{BT12}$ pulse periods (60 BT pulses) to bring the first possible I4PLSE' pulse into alignment with an NT1 pulse generated by the keyboard multiplexer. Thus, an ODOC12 pulse (FIG. 5) occurring during an ODOC21 pulse enables the counter 48. The rising edge of the ODOC12 pulse occurs at the rising edge of an NT1 pulse. When counter 48 is enabled, the counter output is 00(hex). The first $\overline{BT11}$ pulse occurring during the ODOC12 pulse clocks the counter to 01(hex), i.e. the next key number, while resetting the Q output of flip-flop 102 to "0". When a match is detected by comparator 64, sometime prior to the next $\overline{BT11}$ pulse, the Q output of flip-flop 102 is set to "1" as previously explained. The Q output of the flip-flop 102 is reset to "0" by the following $\overline{BT11}$ pulse. As a result, a pulse of variable width appears at the Q output of flip-flop 102.

Flip-flop 104 converts the pulse at the Q output of flip-flop 102 to a pulse which is 12 BT pulses (1 NT pulse) wide at its Q output. As such, the pulse has a width identical to that of an I4PLSE produced by the keyboard multiplexer. But the rising edge of the pulse occurs 11 BT pulses after the NT1 pulse aligned with the rising edge of the ODOC12 pulse. Thus, the first pulse which can be produced by flip-flop 104, representing the first key in a ½ octave, is not aligned with the NT1 pulse. The NT1 pulse, however, represents the first key in a ½ octave.

To bring the pulse output of flip-flop 104 into alignment with the NT1 pulse, the Q output of flip-flop 104 is clocked into the shift register 106 by the $\overline{BT12}$ pulse immediately following the $\overline{BT11}$ pulse which resets flip-flop 102 and clocks the Q output of flip-flop 102 into flip-flop 104. Thereafter, the following five $\overline{BT12}$ pulses shift the Q output of flip-flop 104 through the shift register to the I4PLSE' line. The pulse output of the shift register is the desired I4PLSE' pulse, aligned with an NT1 pulse.

Figure 12:
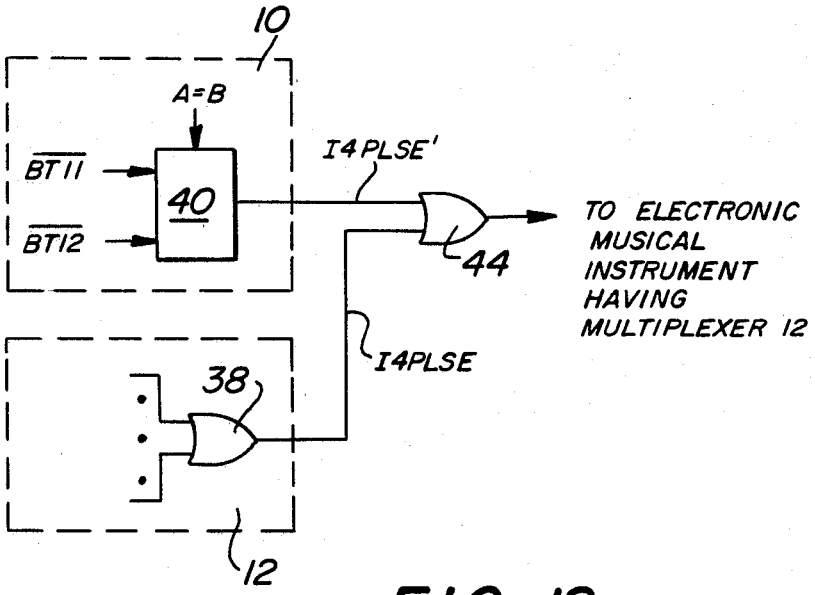
FIG. 12 is a segmented block diagram of the asynchronous interface coupled to a logic circuit for operating the electronic musical instrument in response to synthesized as well as manually generated keyboard pulses.

As mentioned previously, the synthesized I4PLSE' pulses may be substituted for the normal I4PLSE pulses (FIG. 11) or may be ORed with the normal I4PLSE pulses (FIG. 12).

In the preferred embodiment described herein, up to twelve key numbers are transmitted between DATA VALID transitions, from the computer to a buffer memory. The choice of 12 key numbers, however, imposes no restriction on the note capacity of the invention as more or less than twelve key numbers may be used by merely changing the storage capacity of the memories.

It should be noted that the interface lines WRITE ADDRESS and DEVICE SELECT may be connected directly to the computer address bus, the WRITE DATA lines may be connected directly to the computer data bus, the $\overline{WRITE}$ line may be connected directly to the computer memory write signal line, and the DATA VALID line may be connected directly to an output flag line from the computer. In this case, the buffer memories 66 and 68 actually function as a part of the computer memory field. Alternatively, the interface may be connected to the computer output ports as shown in FIG. 1.

In operation, the DEVICE SELECT code generated by the computer selects the interface(s) to be written into. It is first assumed that the interface buffer memory 66 is being read from, so that the computer is writing into buffer memory 68. See FIGS. 14A and 14B. With BSEL and $\overline{WRITE}$ high, buffer memory 68 is disabled ($\overline{B\ ENABLE}$ high). When $\overline{WRITE}$ pulse goes low, it causes the key data on the WRITE DATA lines to be written into memory 68 ($\overline{B\ WRITE}$ low) at the address present on the WRITE ADDRESS lines (WA1, 2, 4, 8). The address is gated through to the memory 68 ADDRESS inputs (A0–A3) by data selector 76 (see FIGS. 7, 8 and 9). Through this procedure, all twelve key numbers (WRITE DATA) are transferred in sequence into memory 68. To complete the transfer of data to the interface, $\overline{WRITE}$ pulse goes high, memory 68 is disabled, and DATA VALID is reversed. Buffer memory 68 is now read from, and memory 66 is disabled and available for writing during the next $\overline{WRITE}$ pulse.

To play specific notes of the musical instrument, the desired key codes or numbers (WRITE DATA) are generated by the computer and loaded into buffer memory 66 or 68. The WRITE DATA comprises twelve 8 bit words which are the key codes or numbers corresponding to the key closures being synthesized. The codes or numbers are selected from the numbers appearing in Table 4 above. If a given key number or numbers appears in two or more successive blocks of WRITE DATA, the note or notes corresponding to the synthesized key pulse I4PLSE' will be sustained with no breaks. If the WRITE DATA includes less than twelve key codes, the remaining WRITE DATA words are filler words. The filler words do not cause an I4PLSE' to be generated since they do not result in a match condition at the comparator 64. All twelve WRITE DATA words, including any filler words, are always read from the buffer memory. For example, the 8 bit binary counter 48 (FIG. 6) does not generate counts F0–FF (hexadecimal), and the presence of any of these numbers in a buffer memory will not cause an I4PLSE' to be generated. The F0–FF numbers may therefore be used as fillers to fill the buffer memory locations when less than twelve notes are to be played.

Once WRITE DATA has been written into one of the buffer memories 66, 68 and that buffer memory is presently being read from, the notes specified by the numbers in the buffer memory will be sounded continuously until DATA VALID changes state. It is necessary to transfer WRITE DATA to the interface only when it is desired to change the notes presently being sounded. At such times that new notes are desired, the computer may generate WRITE DATA identifying the new notes so that the interface can write the data into the idle buffer memory. The new numbers may be generated in one sequential burst, followed by the DATA VALID transition. The stored new numbers are then read from memory and the corresponding notes are played by the musical instrument. Alternatively, the new numbers can be generated and written into the idle buffer memory in random fashion, as they have no effect on the instrument i.e. they are not read from memory, until the DATA VALID transition. Due to the slow rate at which musical notes change as compared to the speed at which the WRITE DATA can be generated by a computer there is considerable computer time reserved for other uses.

Figure 14A:
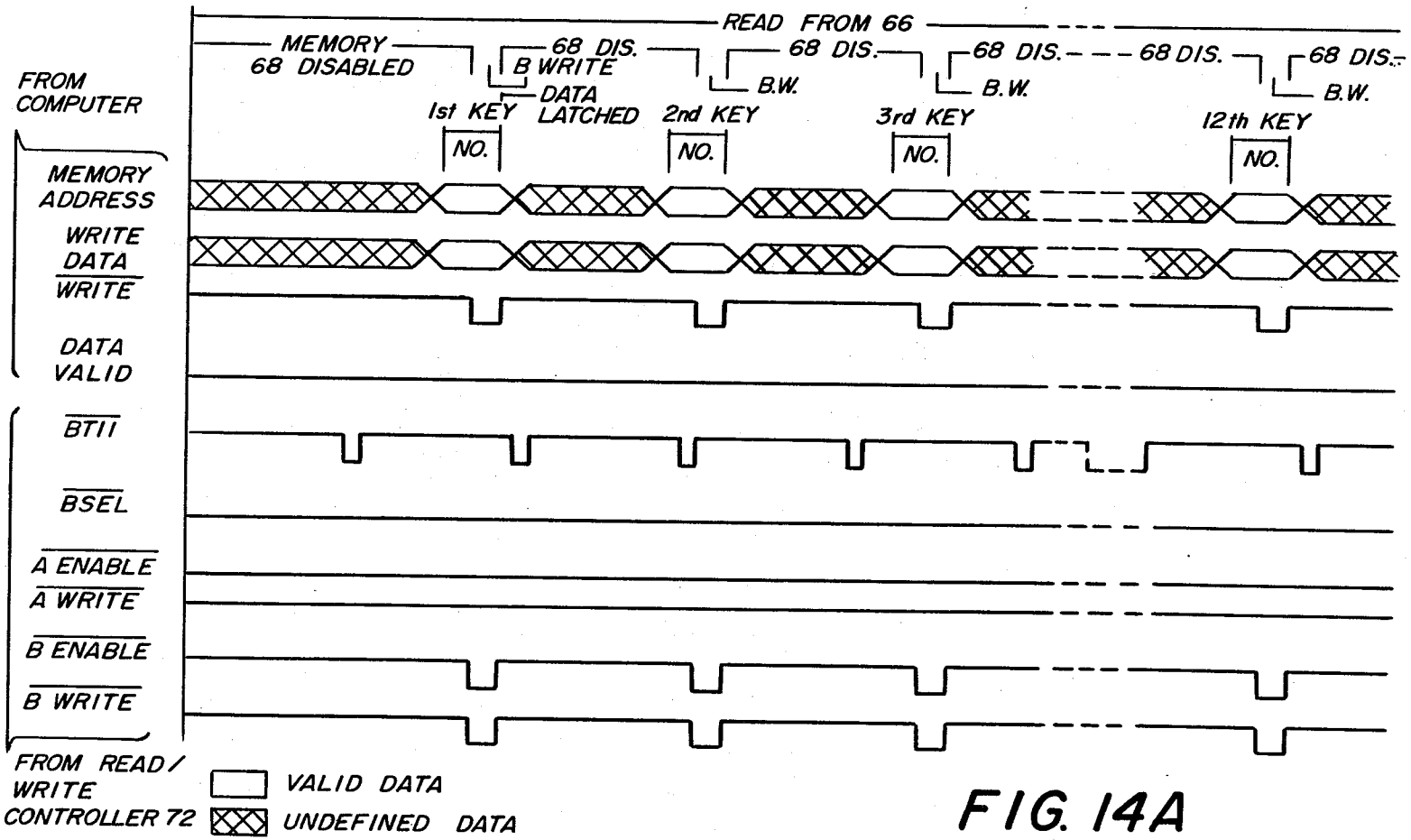
FIGS. 14A and 14B comprise a diagram showing the timing of the read and write operations for the asynchronous interface in FIG. 1.
Figure 14B:
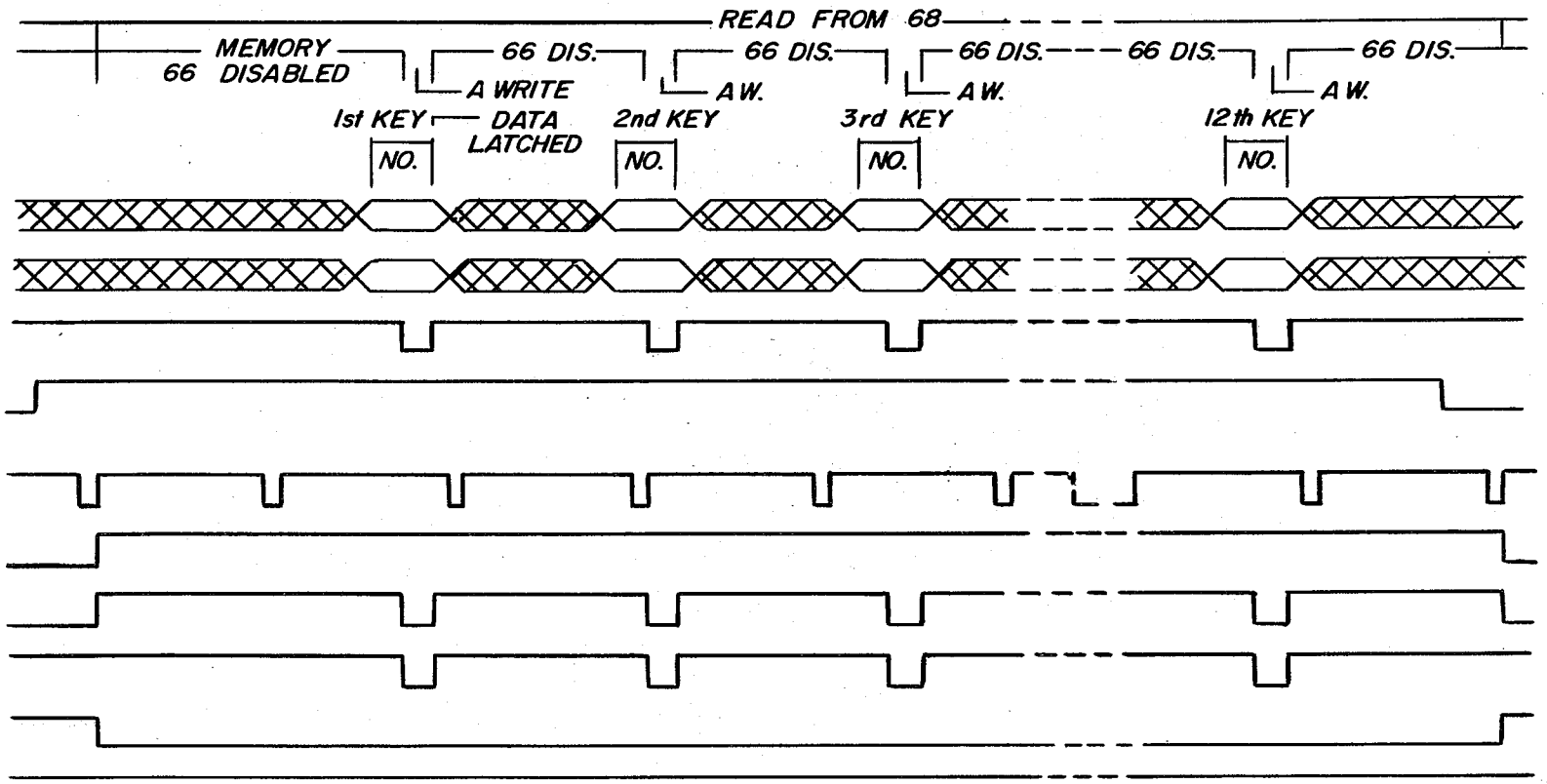

The timing shown in FIGS. 14A and 14B is exemplary only. The clocking of DATA VALID by $\overline{BT11}$, which synchronizes the enabling and disabling of the buffer memories, is the only "fixed" quantity, the timing of all other signals being determined by the computer and its program. The WRITE DATA is shown in FIGS. 14A and 14B as a sequential burst of twelve numbers for convenience and clarity. Those skilled in the art will recognize that the data can be written into a buffer memory in any order, the sole constraint being that the data setup and hold times as well as the write pulse widths specified by the manufacturer of the memory employed be respected. The data setup time represents the minimum time that the memory address and data signals must be present at the memory before the enable and write pulses are applied; and the hold time represents the length of time that the address and data signals must remain at the memory after writing. The write and enable pulses must not be shorter in duration than the minimum durations specified by the manufacturer. With the exception of these constraints, data transfer from computer to interface is essentially at the discretion of the computer operator.

Figure 10:
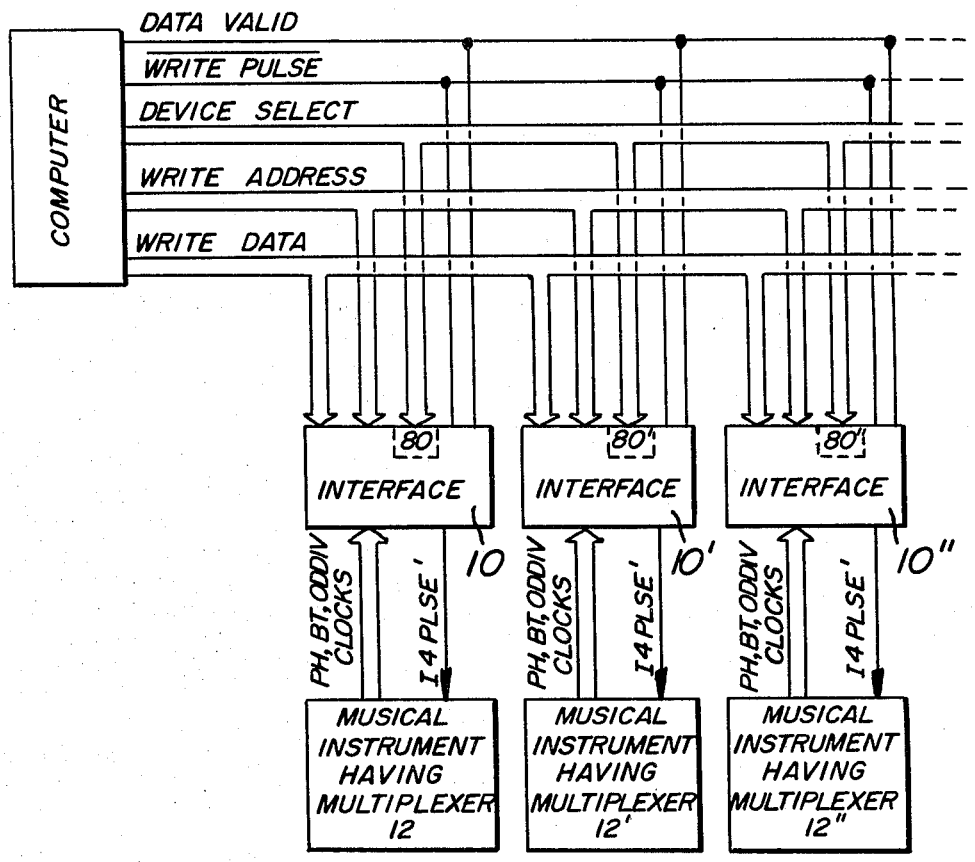
FIG. 10 is a block diagram of a system incorporating plural asynchronous interfaces according to the invention.

Referring to FIG. 10, several asynchronous interfaces 10, 10' and 10'' may be used in a system comprising a like number of electronic musical instruments, each of which is provided with a keyboard multiplexer 12, 12' and 12''. The interfaces are connected for independent control, rather than operation in unison. All interfaces are tied to common busses. Only the interface(s) selected by the DEVICE SELECT code will be written into during the $\overline{WRITE}$ pulse, the $\overline{WRITE}$ pulse being gated by the DEVICE SELECT code. A DATA VALID transition causes each pair of buffer memories to change read and write functions simultaneously (within one BT period); therefore, all buffer memories of selected interfaces having the same identifying code are updated with WRITE DATA before the DATA VALID signal changes state. The system shown in FIG. 10 is only one of many possible configurations. For example, a separate DATA VALID line could be provided for each interface, and the DEVICE SELECT, WRITE ADDRESS, and WRITE DATA lines could all be multiplexed onto one set of wires.

The preferred embodiment of the asynchronous interface described herein can be operated in response to a computer comprising a programmed RCA CDP 1802 microprocessor. It should be understood, however, that the computer does not form a part of the invention per se, and that any suitable computer could be employed to control a musical instrument via the interface of the present invention.

Provided below, in Table 7, is a listing of various components of the asynchronous interface of the present invention by manufacturer's serial number.

TABLE 7

| Device | Device Serial No. |
|---|---|
| FIG. 6 | |
| 52, 54 | SN7408 |
| 100 | SN7400 |
| 56 | SN7473 |
| 60, 62, 102, 104 | SN7474 |
| 48 | SN74161 |
| 64 | SN7485 |
| 106 | SN74164 |
| FIG. 7 | |
| 66, 68 | DM74LS189 |
| FIG. 8 | |
| 74, 76 | SN7451 |
| FIG. 9 | |
| 78 | SN74161 |
| 82 | SN7485 |
| 98 | SN7474 |
| 88, 94, 96 | SN7432 |
| 90, 92 | SN7408 |

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for synthesizing a series of pulses for use by an electronic musical instrument in response to data provided by an external data input device, said data being indicative of one or more notes to be played by the instrument, the instrument having a multiplexer for producing a multiplexed signal asynchronously with respect to said data, said multiplexed signal comprising a series of time slots, each of which corresponds to a note which can be played by the musical instrument, comprising:

key number generating means for generating key numbers;

at least first and second buffer memories;

writing control means for alternately causing said data to be written into said first buffer memory during a first interval of time and into said second buffer memory during a second interval of time;

reading control means for alternately causing data written into said second buffer memory to be read out of said second buffer memory during said first interval of time and for causing data written into said first buffer memory to be read out of said first buffer memory during said second interval of time;

comparator means for comparing said data read out of a buffer memory to said key numbers and for producing a signal indicative or a match between data read out of the buffer memory and at least one of said key numbers; and means for synthesizing a series of pulses in response to said signal indicative of said match.

2. Apparatus according to claim 1 including means for detecting a predetermined device select code generated by the external data device, and means for preventing said writing control means from causing said data to be written into said buffer memories unless said predetermined device select code is detected.

3. Apparatus according to claim 1 wherein said writing control means includes means for writing said data into a buffer memory at a first rate equal to the rate that said data is generated by the external data device, and wherein said reading control means includes means for reading said data out of a buffer memory at a second rate substantially greater than said first rate.

4. Apparatus according to claim 1 wherein said key number generating means includes a counter for generating said key numbers, and means for enabling said counter and said comparator means during a preselected portion of the multiplexed signal generated by the multiplexer and for inhibiting said counter and said comparator means during the remaining portion of the multiplexed signal.

5. Apparatus according to claim 1 including means for combining said synthesized pulses with said multiplexed signal produced by said multiplexer for use by the electronic musical instrument.

6. Apparatus according to claim 1 wherein said first and second buffer memories are RAMs.

7. A method of synthesizing a series of pulses for use by an electronic musical instrument in response to data provided by an external data device, said data being indicative of one or more notes to be played by the instrument, the instrument having a multiplexer for producing a multiplexed signal asynchronously with respect to said data, said multiplexed signal comprising a series of time slots each of which corresponds to a note which can be played by the musical instrument, comprising;

generating key numbers synchronously with respect to said multiplexed signal, each of said key numbers corresponding to a time slot of said multiplexed signal;

alternately storing said data in a first buffer memory and in a second buffer memory, one buffer memory at a time, during successive intervals of time;

alternately reading stored data out of said first and second buffer memories, one buffer memory at a time, during said successive intervals of time;

detecting a match between data read out of a buffer memory and at least one of said key numbers; and synthesizing a serial stream of pulses in synchronism with said multiplexed signal for use by the electronic musical instrument based on said detecting step, each of said synthesized pulses occurring in a time slot in the multiplexed signal and corresponding to a note to be played by the instrument.

8. The method according to claim 7 including:

detecting a predetermined device select code generated by the external data device;

preventing storage of said data in said buffer memories unless said predetermined device select code is detected.

9. The method according to claim 7 wherein said step of alternately storing said data includes storing said data in a buffer memory at a first rate equal to the rate that said data is generated by the external data device and wherein said step of alternately reading said stored data includes reading said stored data out of the buffer memory at a second rate substantially greater than said first rate.

10. The method according to claim 7 including:

enabling the generation of said key numbers and the detection of a match between said data and at least one of said key numbers during a preselected portion of said multiplexed signal; and inhibiting the generation of said key numbers and the detection of a match between said data and at least one of said key numbers during the remaining portion of the multiplexed signal.

11. The method according to claim 7 including combining said serial stream of synthesized pulses and said multiplexed signal for use by the electronic musical instrument.

12. Apparatus for synthesizing multiplexed keyboard pulses for use by an electronic musical instrument in response to key data provided by an external data input device, the instrument having a keyboard and a keyboard multiplexer for scanning the keyboard and producing multiplexed keyboard pulses asynchronously with respect to said key data, said multiplexed keyboard pulses being representative of notes to be played by the instrument, comprising:

key number generating means for generating key numbers;

at least first and second buffer memories;

writing control means for alternately causing said key data to be written into said first buffer memory during a first interval of time and into said second buffer memory during a second interval of time;

reading control means for alternately causing said key data written into said second buffer memory to be read out of said second buffer memory during said first interval of time and for causing said key data written into said first buffer memory to be read out of said first buffer memory during said second interval of time;

comparator means for comparing said key data read out of a buffer memory to said key numbers and for producing a signal indicative of a match between said key data read out of the buffer memory and at least one of said key numbers; and means for synthesizing multiplexed keyboard pulses in response to said signal indicative of said match.

13. Apparatus according to claim 12 including means for detecting a predetermined device select code generated by the external data device, and means for preventing said writing control means from causing said key data to be written into said buffer memories unless said predetermined device select code is determined.

14. Apparatus according to claim 12 wherein said writing control means includes means for writing said key data into a buffer memory at a first rate equal to the rate that said key data is generated by the external data device, and wherein said reading control means includes means for reading said key data out of a buffer memory at a second rate substantially greater than said first rate.

15. Apparatus according to claim 12 wherein said key number generating means includes a counter for generating said key numbers, and means for enabling said counter and said comparator means during a preselected portion of a scan of the instrument keyboard by the keyboard multiplexer and for inhibiting said counter and said comparator means during the remaining portion of the scan.

16. Apparatus according to claim 12 including means for combining said synthesized multiplexed keyboard pulses with said multiplexed keyboard pulses produced by said keyboard multiplexer for use by the electronic musical instrument.

17. Apparatus according to claim 12 wherein said first and second buffer memories are RAMs.

* * * * *